US009580930B2

(12) United States Patent
Sadinsky et al.

(10) Patent No.: US 9,580,930 B2
(45) Date of Patent: Feb. 28, 2017

(54) FENCE AND METHOD OF ASSEMBLING SAME

(71) Applicant: Guardian Pool Fence Systems, Inc., Van Nuys, CA (US)

(72) Inventors: Steven E. Sadinsky, Northridge, CA (US); Adam H. Sadinsky, Northridge, CA (US); Stuart Long, Camarillo, CA (US)

(73) Assignee: Guardian Pool Fence Systems, Inc., Van Nuys, CA (US)

( * ) Notice: Subject to any disclaimer, the term of this patent is extended or adjusted under 35 U.S.C. 154(b) by 626 days.

(21) Appl. No.: 13/802,310

(22) Filed: Mar. 13, 2013

(65) Prior Publication Data

US 2014/0264218 A1 Sep. 18, 2014

(51) Int. Cl.
*E04H 17/16* (2006.01)
*E06B 11/02* (2006.01)

(52) U.S. Cl.
CPC ..... *E04H 17/163* (2013.01); *E06B 11/02* (2013.01)

(58) Field of Classification Search
CPC ... E04H 17/16; E04H 17/1417; E04H 17/163; E04H 17/165; E04H 17/166; E06B 11/02
USPC ..... 256/19, 24, 59, 65.01, 68, 65.02, 65.03, 256/65.04, 65.05, 73
See application file for complete search history.

(56) References Cited

U.S. PATENT DOCUMENTS 2,468,296 A * 4/1949 Jacobowitz et al. ..... 210/486
2,975,536 A * 3/1961 Schindler ..... 52/656.8
4,727,702 A * 3/1988 Baker et al. ..... 52/656.8
5,301,984 A * 4/1994 Farris ..... 285/55
5,664,769 A 9/1997 Sadinsky et al.
5,904,628 A * 5/1999 MacKay et al. ..... 473/326
6,131,886 A * 10/2000 Venegas, Jr. ..... 256/59
6,283,457 B1 * 9/2001 Venegas, Jr. ..... 256/65.05
6,561,089 B1 * 5/2003 Newman, Jr. ..... 101/127.1
7,334,957 B2 2/2008 Sadinsky et al.
7,503,550 B2 * 3/2009 Liefke ..... 256/24
7,540,472 B2 * 6/2009 Striebel et al. ..... 256/67
7,686,283 B2 * 3/2010 Marchio ..... 256/73
8,342,771 B2 * 1/2013 Goad ..... 403/292
8,387,955 B2 * 3/2013 Ptacek et al. ..... 256/31
8,650,741 B1 * 2/2014 Piper et al. ..... 29/525.01
(Continued)

*Primary Examiner* — Gregory Binda
*Assistant Examiner* — Nahid Amiri
(74) *Attorney, Agent, or Firm* — Lewis Roca Rothgerber Christie LLP

(57) ABSTRACT

A gate configured to be shipped in a compact disassembled state and assembled in situ into a structurally rigid frame around an area is provided. In one embodiment, the gate includes first and second vertical support posts, a lower horizontal support, a cross-brace, first and second upper vertical posts, a screen, first and second elbow joints, and first and second Tee joints. The elbow joints are configured to couple the vertical support posts to the lower horizontal support. The Tee joints are configured to couple the vertical support posts, the upper vertical posts, and the cross-brace together. The screen is configured to be coupled to the vertical support posts, the upper vertical posts, and the lower horizontal support post. The cross-brace is configured to extend between the first and second vertical support posts at a distance below the upper end of the screen and rearwardly away from the screen.

18 Claims, 11 Drawing Sheets

(56) References Cited

U.S. PATENT DOCUMENTS

| | | | | |
|---|---|---|---|---|
| 8,651,463 | B2 * | 2/2014 | Mao-Cheia et al. | 256/65.04 |
| 9,359,787 | B2 | 6/2016 | Callahan et al. | |
| 2006/0231821 | A1 * | 10/2006 | Gavin | E06B 11/02 256/73 |
| 2009/0032790 | A1 * | 2/2009 | Timms | 256/25 |
| 2011/0253962 | A1 | 10/2011 | Sadinsky et al. | |
| 2012/0261630 | A1 | 10/2012 | Sadinsky et al. | |

* cited by examiner 151
153
402
423
115
417
112
424
193
400
190
150
153
401
115
111

FENCE AND METHOD OF ASSEMBLING SAME

TECHNICAL FIELD

The present invention relates generally to gates, and more particularly to gates for swimming pool fences.

BACKGROUND OF THE INVENTION

Unsecured pools present a drowning hazard to unattended children. Accordingly, pools are commonly provided with a fence surrounding the pool to prevent children from inadvertently falling into the pool. Additionally, the fence surrounding the pool is commonly provided with a gate to allow convenient access to and from the pool. Moreover, such gates are commonly provided with locks to prevent children from opening the gate. Conventional gates also may be provided with structural members not present on the remainder of the fence because the gate is subject to additional loading due to the repeated opening and closing of the gate. These additional structural members on conventional gates, however, may be configured such that children can climb over the gate and thereby access the pool. For instance, conventional gates may include structural features, such as rods, poles, or stringers, which permit children to scale the gate and thereby access the pool.

Additionally, conventional pool fences and gates are typically shipped in a fully or partially assembled state in order to ensure the structural integrity and rigidity of the fence and gate upon installation around the pool. Gates, in particular, are typically shipped in an assembled state. However, shipping fences and gates in a partially or fully assembled state requires a large shipping container, which adds significant delivery expense to the fence and gate and limits the type of vehicles which are capable of transporting the fence and gate. An assembled gate will have a width and height that will take considerable clearance for packing and shipping.

As such, there is a need for a fence and gate which are configured to prevent children from climbing the gate and which are configured to be transported in a compact disassembled state and then assembled in situ into a structurally rigid frame around the pool.

SUMMARY OF THE INVENTION

The present invention is directed to a fence and a gate configured to prevent children from climbing the gate and configured to be transported in a compact disassembled state and then assembled in situ into a structurally rigid frame around a pool or other area. In one embodiment of the present invention, the gate includes first and second vertical support posts each having opposing upper and lower ends, a lower horizontal support having opposing ends, a cross-brace having opposing ends, first and second upper vertical posts each having opposing upper and lower ends, a screen having opposing sides and opposing upper and lower ends, first and second elbow joints, and first and second Tee joints, wherein at least a portion of one of the opposing sides of the screen is configured to be coupled to the first vertical support post and the first upper vertical post, at least a portion of the other one of the opposing sides of the screen is configured to be coupled to the second vertical support post and the second upper vertical post, at least a portion of the lower end of the screen is configured to be coupled to the lower horizontal support, the cross-brace is configured to extend between the first and second vertical support posts at a distance below the upper end of the screen when the gate is assembled, at least a portion of the cross-brace is configured to be spaced rearwardly away from the screen by a distance when the gate is assembled, the first elbow joint is configured to couple the lower end of the first vertical support post to one of the opposing ends of the horizontal support, the second elbow joint is configured to couple the lower end of the second vertical support post to the other one of the opposing ends of the horizontal support, the first Tee joint is configured to couple the upper end of the first vertical support post, one of the opposing ends of the cross-brace, and the lower end of the first upper vertical post together, and the second Tee joint is configured to couple the upper end of the second vertical support post, the other one of the opposing ends of the cross-brace, and the lower end of the second upper vertical post together. In one embodiment, the distance the cross-brace is spaced below the upper end of the screen is between approximately 4 inches and approximately 8 inches, and the distance the cross-brace is configured to be spaced rearwardly away from the screen is between approximately 2 inches and approximately 3 inches.

In one embodiment, each of the first and second elbow joints includes a vertical leg having a free upper end and a lower end, a horizontal leg extending inward from the vertical leg, the horizontal leg having an interconnected end connected to the lower end of the vertical leg and a free end opposite the interconnected end, an annular lip on the free upper end of the vertical leg, the annular lip having an outer diameter, and an annular lip on the free end of the horizontal leg, the annular lip having an outer diameter. In another embodiment, each of the first and second vertical support posts is a tubular member having inner and outer diameters, the inner diameter defined by smooth bore extending along the vertical support post, the lower horizontal support is a tubular member having inner and outer diameters, the inner diameter defined by a smooth bore extending along the lower horizontal post, the annular lips on the vertical legs of the elbow joints are configured to be inserted into the bores in the lower ends of the vertical support posts, and the annular lips on the horizontal legs of the elbow joints are configured to be inserted into the bore in the opposing ends of the lower horizontal support. In one embodiment, the outer diameter of the annular lip on the vertical leg of each of the elbow joints is slightly smaller than the inner diameter of the bores in the first and second vertical support posts. In another embodiment, the outer diameter of the annular lip on the vertical leg of each of the elbow joint is substantially equal to the inner diameter of the bores in the first and second vertical support posts. In yet another embodiment, each of the first and second elbow joints further comprises a narrow groove extending along at least a portion of the vertical and horizontal legs. In one embodiment, each of the first and second elbow joints comprises fiberglass.

In one embodiment, each of the first and second Tee joints includes a vertical leg having free upper and lower ends, a horizontal leg extending inward from the vertical leg, the horizontal leg having an interconnected end connected to the vertical leg and a free end opposite the interconnected end, the horizontal leg equidistantly disposed between the upper and lower ends of the vertical leg, an annular lip on the free upper end of the vertical leg, an annular lip on the free lower end of the vertical leg, and an annular lip on the free end of the horizontal leg. In one embodiment, the horizontal leg of each Tee is curved. In one embodiment, each of the first and second vertical support posts is a tubular member having inner and outer diameters, the inner diameter defined by a smooth bore extending along the vertical support post, each of the upper vertical posts is a tubular member having inner and outer diameters, the inner diameter defined by a smooth extending along the upper vertical post, the cross-brace is a tubular member having inner and outer diameters, the inner diameter defined by a smooth bore extending along the cross-brace, the annular lips on the free upper ends of the vertical legs of the Tee joints are configured to be inserted into the bores in the lower ends of the upper vertical posts, and the annular lips on the free lower ends of the vertical legs of the Tee joints are configured to be inserted into the bores in the upper ends of the vertical support posts, and the annular lips on the free ends of the horizontal legs of the Tee joints are configured to be inserted into the bore in the opposing ends of the cross-brace.

In one embodiment, the gate includes a first tensioning plate configured to clamp one of the opposing sides of the screen to the first vertical support post and the first upper vertical post, a second tensioning plate configured to clamp the other one of the opposing sides of the screen to the second vertical support post and the second upper vertical post, and a third tensioning plate configured to clamp the lower edge of the screen to the lower horizontal support. In one embodiment, each of the tensioning plates comprises a flat plate and a pair of teeth canted inward from opposite sides of the flat plate.

In one embodiment, the gate includes upper edge bindings extending along the upper edge of the screen, lower edge bindings extending along the lower edge of the screen, and side edge bindings extending along the opposing sides of the screen.

In one embodiment, a fence and gate assembly surrounding a pool having a pool decking adjacent to the pool is provided. In one embodiment, the fence and gate assembly includes a fence including a plurality of fence posts inserted into a plurality of openings in the pool decking, a fence screen tensioned between the plurality of fence posts, and at least one access opening defined between two adjacent fence posts, and at least one gate provided in the at least one access opening in the fence and coupled to one of the fence posts defining the access opening, the at least one gate including first and second vertical support posts having opposing upper and lower ends, a lower horizontal support coupled to the lower ends of the first and second vertical support posts, first and second upper vertical posts each having opposing upper and lower ends, the lower ends of the upper vertical posts coupled to the upper ends of the vertical support posts, a gate screen having opposing sides and opposing upper and lower ends, the opposing sides of the screen coupled to the first and second vertical support posts and the first and second upper vertical posts, the lower end of the screen coupled to the lower horizontal support, and a cross-brace coupled to the first and second vertical support posts, wherein the cross-brace is spaced a distance below the upper end of the gate screen, and the cross-brace is disposed on an inner pool-facing side of the gate between the gate screen and the pool. In one embodiment, at least a portion of the cross-brace is spaced a distance rearward from the gate screen. In one embodiment, the distance the cross-brace is spaced below the upper end of the screen is between approximately 4 inches and approximately 8 inches and the distance the cross-brace is spaced rearward from the gate screen is between approximately 2 inches and approximately 3 inches. In yet another embodiment, the gate and fence assembly includes a latch coupled to the other vertical support post defining the opening in the fence, the latch configured to secure the gate in a closed position. In one embodiment, the gate is hingedly coupled to the fence by at least one spring-loaded hinge biasing the gate into a closed position. In another embodiment, the apertures in the pool decking are canted relative to an imaginary vertical axis.

In one embodiment, a method of restricting access to an area is provided. In one embodiment, the method includes obtaining a package of fence and gate components, the package including a plurality of fence posts, a fence screen, first and second vertical support posts each having opposing upper and lower ends, a lower horizontal support having opposing ends, a cross-brace having opposing ends, first and second upper vertical posts each having opposing upper and lower ends, a gate screen having opposing sides and opposing upper and lower ends, first and second elbow joints, and first and second Tee joints, wherein at least a portion of one of the opposing sides of the screen is configured to be coupled to the first vertical support post and the first upper vertical post, at least a portion of the other one of the opposing sides of the screen is configured to be coupled to the second vertical support post and the second upper vertical post, at least a portion of the lower end of the screen is configured to be coupled to the lower horizontal support, the cross-brace is configured to extend between the first and second vertical support posts at a distance below the upper end of the screen, the first elbow joint is configured to couple the lower end of the first vertical support post to one of the opposing ends of the horizontal support, the second elbow joint is configured to couple the lower end of the second vertical support post to the other one of the opposing ends of the horizontal support, the first Tee joint is configured to couple the upper end of the first vertical support post, one of the opposing ends of the cross-brace, and the lower end of the first upper vertical post together, and the second Tee joint is configured to couple the upper end of the second vertical support post, the other one of the opposing ends of the cross-brace, and the lower end of the second upper vertical post together.

In one embodiment, at least a portion of the cross-brace is configured to be spaced rearwardly away from the gate screen by a distance when the gate is assembled. In one embodiment, the method includes assembling a fence, which includes inserting portions of the plurality of fence posts into a plurality of openings surrounding the area, and coupling the fence screen to a plurality of the plurality of fence posts, wherein at least one access opening is defined between two adjacent fence posts. In another embodiment, the method includes assembling a gate, which includes coupling the first elbow joint to the lower end of the first vertical support post, coupling the first elbow joint to one of the opposing ends of the lower horizontal support, coupling the second elbow joint to the lower end of the second vertical support post, and coupling the second elbow joint to the other one of the opposing ends of the lower horizontal support. In yet a further embodiment, the method includes coupling the first Tee joint to the upper end of the first vertical support post, coupling the first Tee joint to the lower end of the first upper vertical post, coupling the first Tee joint to one of the opposing ends of the cross-brace, coupling the second Tee joint to the upper end of the second vertical support post, coupling the second Tee joint to the lower end of the second upper vertical post, and coupling the second Tee joint to the other one of the opposing ends of the cross-brace. In one embodiment, the method includes coupling one of the opposing sides of the gate screen to the first vertical support post and the first upper vertical post, coupling the other one of the opposing sides of the gate screen to the second vertical support post and the second upper vertical post, and coupling the lower end of the gate screen to the lower horizontal support. In another embodiment, the method includes hingedly coupling the gate to one of the two adjacent fence posts defining the access opening, wherein the gate is configured to move between an open position in which a user can access the area through the access opening and a closed position in which the user is prevented from accessing the area through the access opening.

This summary is provided to introduce a selection of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

Embodiments of a fence and gate according to the present invention are described with reference to the following figures. The same reference numerals are used throughout the figures to reference like features and components.

DETAILED DESCRIPTION

The present invention is directed to a fence and a gate. The drawings depict the invention as applied to swimming pools for illustrative purposes only, and it is appreciated that the present invention may be used in other applications, such as to restrict access to playground structures (e.g., trampolines), buildings, and other private property (e.g., backyards). The gate and fence of the present invention are configured to prevent children from climbing the gate and thereby accessing the structure or property to which access is limited. Additionally, the gate and fence of the present invention are configured to be shipped in a compact disassembled state and then assembled in situ around the desired structure or property.

Figure 1:
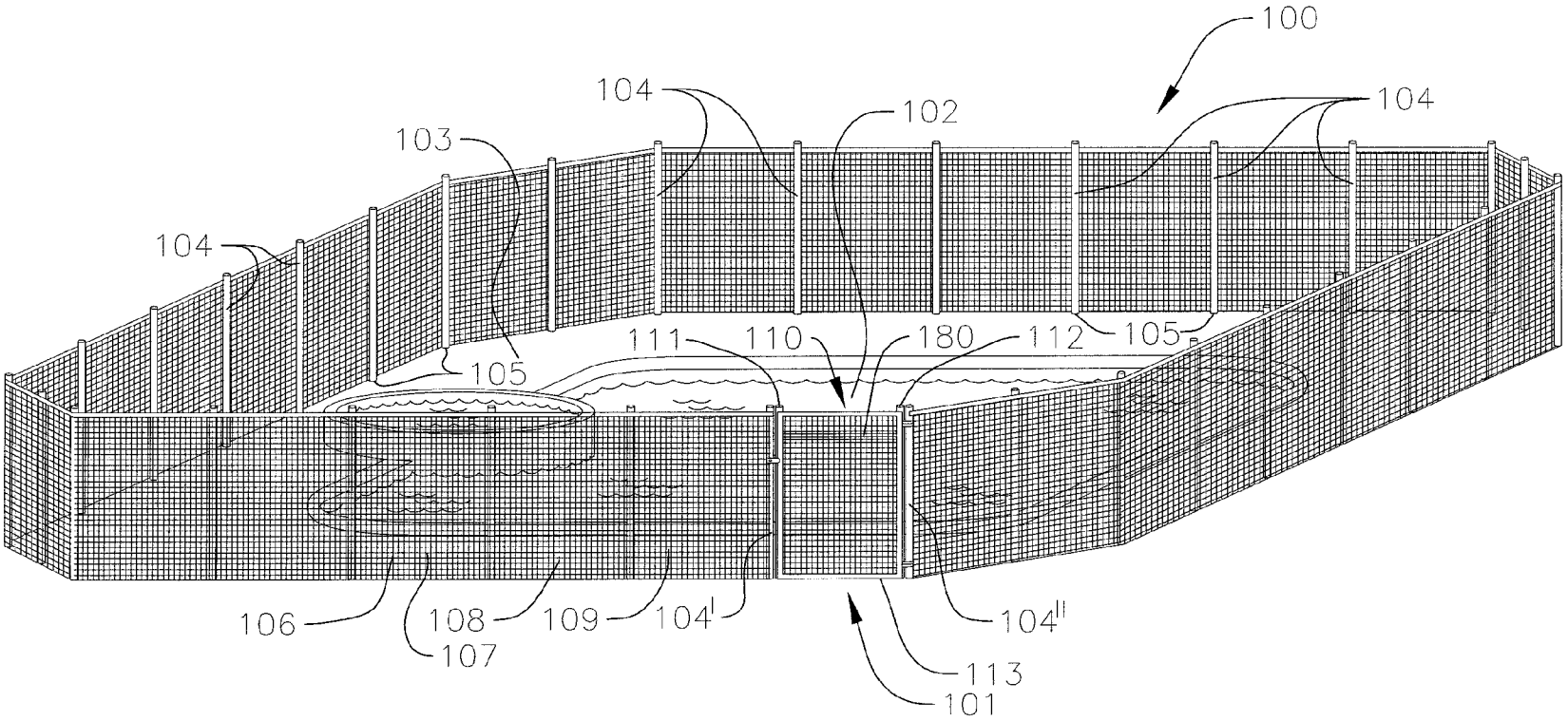
FIG. 1 is a perspective view of a fence and a gate according to an embodiment of the present invention installed around a pool.

With reference now to the embodiment illustrated in FIG. 1, the fence 100 and gate 101 of the present invention are shown installed around the perimeter of a pool 102 having a pool decking 103 adjacent the pool 102. The fence 100 includes a plurality of spaced apart vertical fence posts 104. In the illustrated embodiment, lower ends of the vertical fence posts 104 extend into apertures 105 (e.g., cylindrical bores) in the pool decking 103 or other structure surrounding the pool 102. The vertical fence posts 104 may have any suitable shape, such as thin-walled cylindrical tubes, cylindrical rods, square bars, or flat plates. The vertical fence posts 104 may be made of any suitably strong material, such as aluminum, steel, fiberglass, or carbon fiber reinforced plastic. The fence posts 104 may be formed from any suitable process, such as machining, extruding, molding, or rapid prototyping using additive manufacturing.

With continued reference to FIG. 1, the fence 100 also includes a mesh screen 106 tensioned between the vertical fence posts 104. In one embodiment, the screen 106 may be installed with approximately 15-20 lbs of tension between the vertical fence posts 104. Additionally, the vertical fence posts 104 and the apertures 105 in the pool decking 103 may be canted (e.g., approximately 5 degrees) to compensate for the tension loading on the vertical fence posts 104 supplied by the tensioned screen 106. The screen 106 may be secured to the vertical fence posts 104 by any suitable means, such as bonding, adhering, or fastening.

The screen 106 includes a plurality of interconnected longitudinal strands 107 and transverse strands 108 arranged in a grid-like pattern. The strands 107, 108 may be interconnected by any suitable means, such as interlacing, bonding, adhering, or knotting. Together, the longitudinal and transverse strands 107, 108 define a grid of rectangular openings 109 in the fence 100. In one embodiment, the openings 109 are sized to prevent a child's fingers and toes from extending through the screen 106 (e.g., approximately 0.25 square inches), thereby inhibiting a child from climbing the fence 100. It will be appreciated, however, that the present invention is not limited to the size of the openings 109 recited above, and openings 109 of any suitable size are within the scope and spirit of the present invention. The screen 106 may be made of any suitable strong and durable material, such as aluminum, nylon, or vinyl-coated metal. A suitable fence 100 structure is described in U.S. Pat. No. 5,664,769, assigned to the applicant of the present invention, the entire contents of which are hereby incorporated by reference.

With continued reference to FIG. 1, the fence 100 also includes at least one access opening 110 defined between two adjacent vertical fence posts 104', 104". Gates 101 are provided in each of the access openings 110 in the fence 100 to provide ingress to and egress from the pool or other structure to which the fence 100 restricts access. One side of the gate 101 is hingedly coupled to one of the fence posts 104' defining the access opening 110 such that the gate 101 is configured to move between an open position and a closed position. In one embodiment, the gate 101 may be hingedly coupled to the fence 100 by two spring-loaded hinges, as shown and described in U.S. Pat. No. 5,664,769. The gate 101 and fence 100 may also include a mechanism configured to releasably lock the gate 101 in the closed position, such as a latch and catch, a hook and eye latch, or the magnetic latch shown and described in U.S. Pat. No. 5,664,769. The locking mechanism may be coupled the other fence post 104" defining the access opening 110 and the side of the gate 101 opposite the hinged side of the gate 101.

Figure 2A:
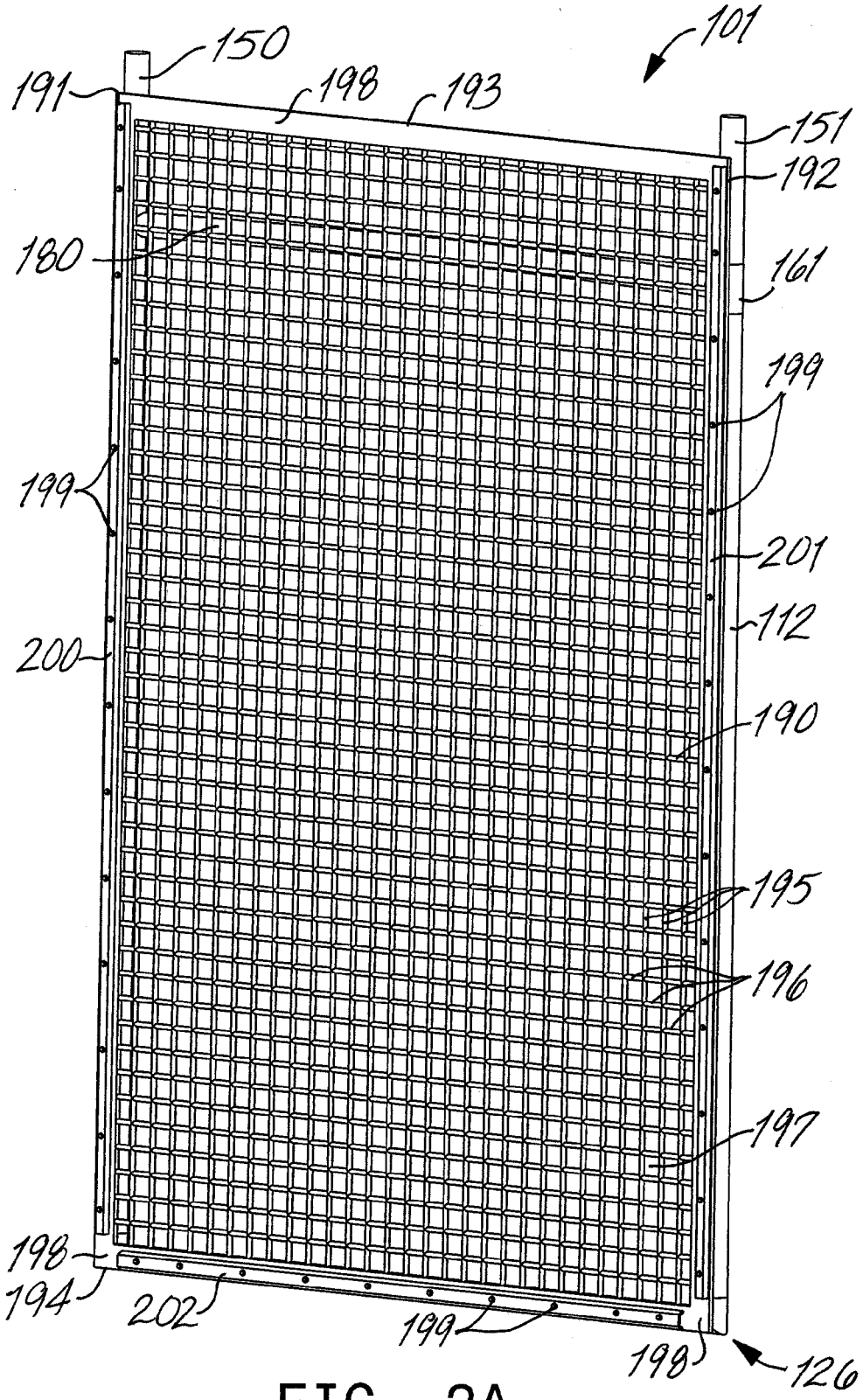
FIGS. 2A and 2B are front and rear perspective views, respectively, of the gate of FIG. 1.
Figure 2B:
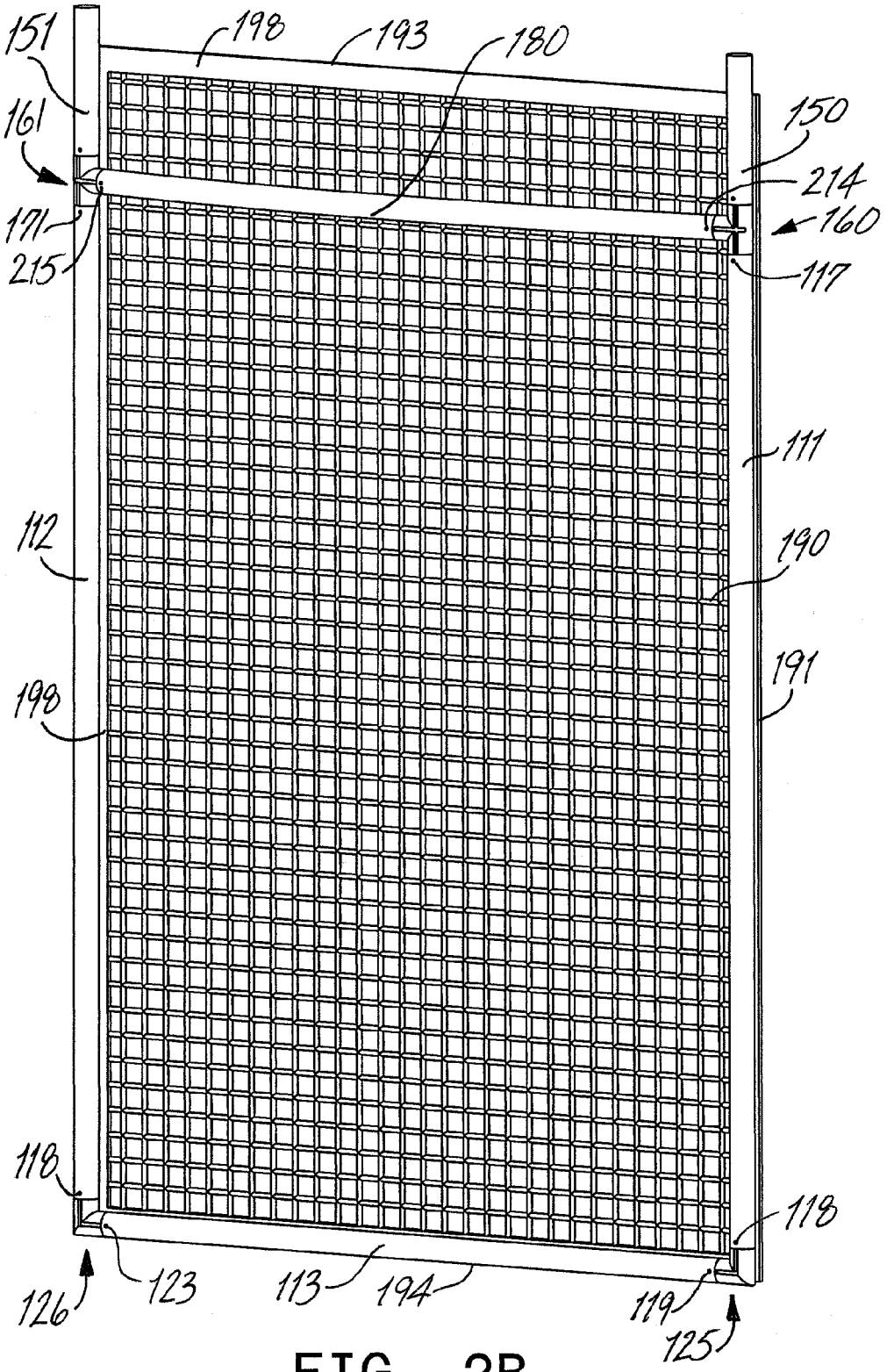
Figure 3:
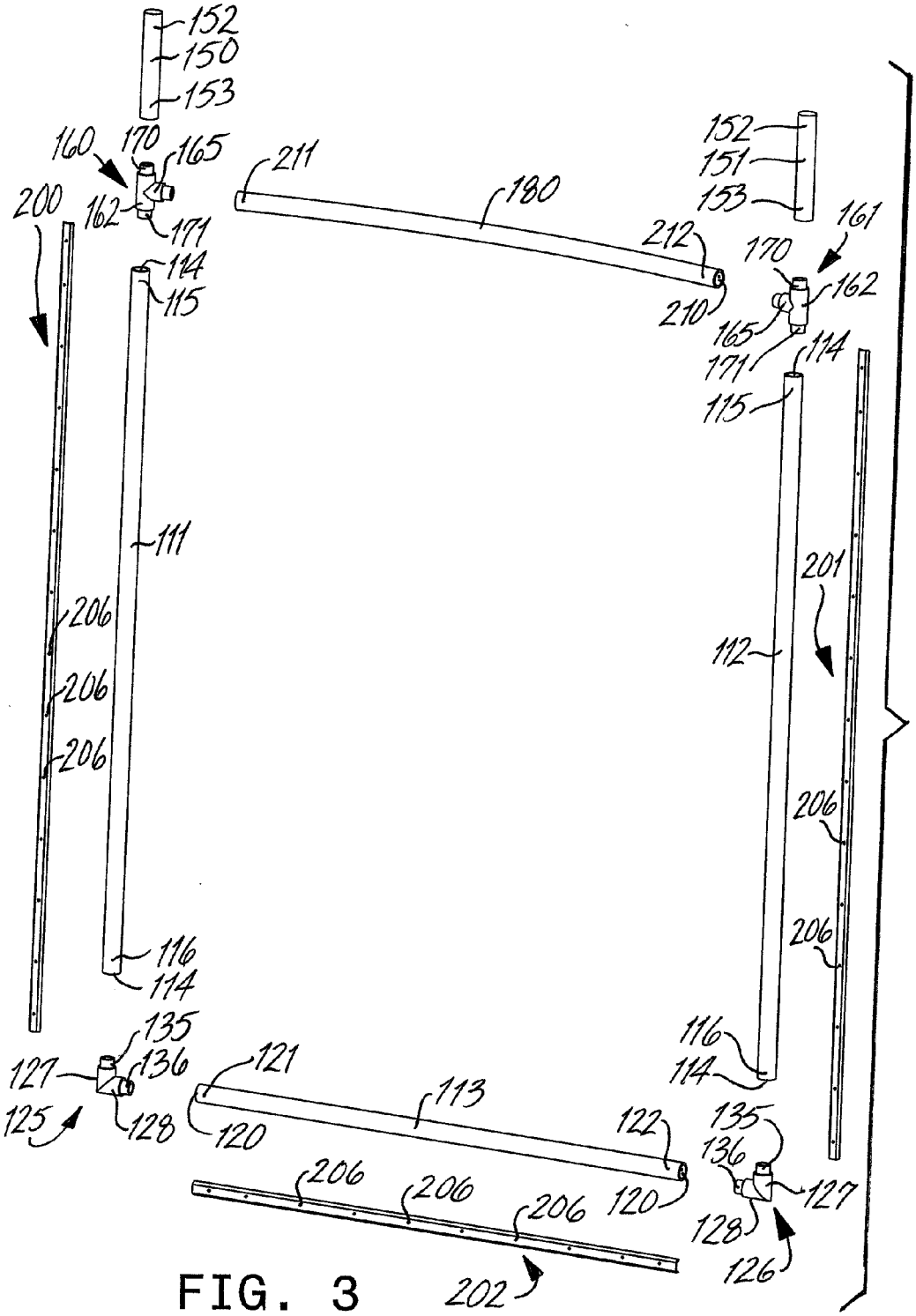
FIG. 3 is an exploded rear perspective view of the gate of FIG. 1.
Figure 6:
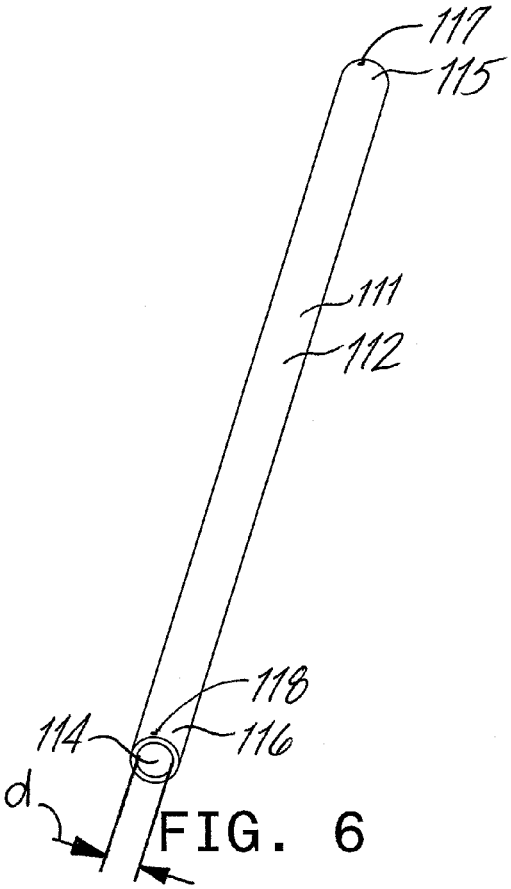
FIG. 6 is a perspective view of a vertical support post according to an embodiment of the present invention.
Figure 7:
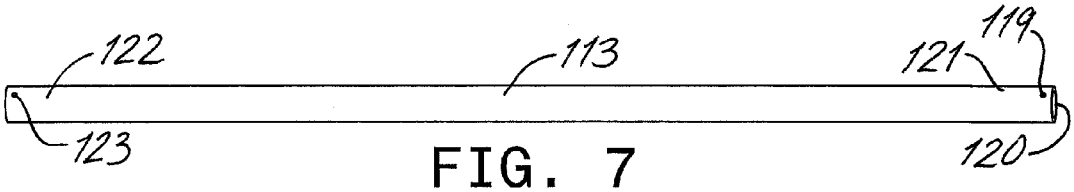
FIG. 7 is a perspective view of a lower horizontal post according to an embodiment of the present invention.

With reference now to the embodiment illustrated in FIGS. 2A, 2B, and 3, the gate 101 includes two spaced apart vertical support posts 111, 112 and a lower horizontal post 113 extending between the vertical posts 111, 112. Together, the vertical support posts 111, 112 and the lower horizontal support 113 define a generally U-shaped frame. In the illustrated embodiment of FIG. 6, the vertical support posts 111, 112 are thin-walled tubes having an outer diameter and an inner diameter d. The inner diameter d of the vertical support posts 111, 112 is defined by a smooth bore 114 extending the entire length of the vertical support posts 111, 112. Upper and lower ends 115, 116 of the vertical support posts 111, 112 include openings 117, 118 (e.g., cylindrical holes), respectively, extending into the bores 114, the significance of which is explained below. Similarly, in the illustrated embodiment of FIG. 7, the lower horizontal support 113 is a thin-walled tube having an outer diameter and an inner diameter. The inner diameter of the lower horizontal support 113 is defined by a smooth bore 120 extending the entire length of the lower horizontal support 113. Opposite ends 121, 122 of the lower horizontal support 113 include openings 119, 123 (e.g., cylindrical holes) extending into the bore 120, the significance of which is explained below. Although the supports 111, 112, 113 are illustrated as tubular members, the supports 111, 112, 113 may have any other suitable shape, such as square bar, flat plate, or cylindrical rod. The supports 111, 112, 113 may be made of any suitably strong material, such as aluminum, steel, fiberglass, or carbon fiber reinforced plastic. The supports 111, 112, 113 may be formed by any suitable process, such as machining, extruding, molding, or rapid prototyping using additive manufacturing.

Figure 4:
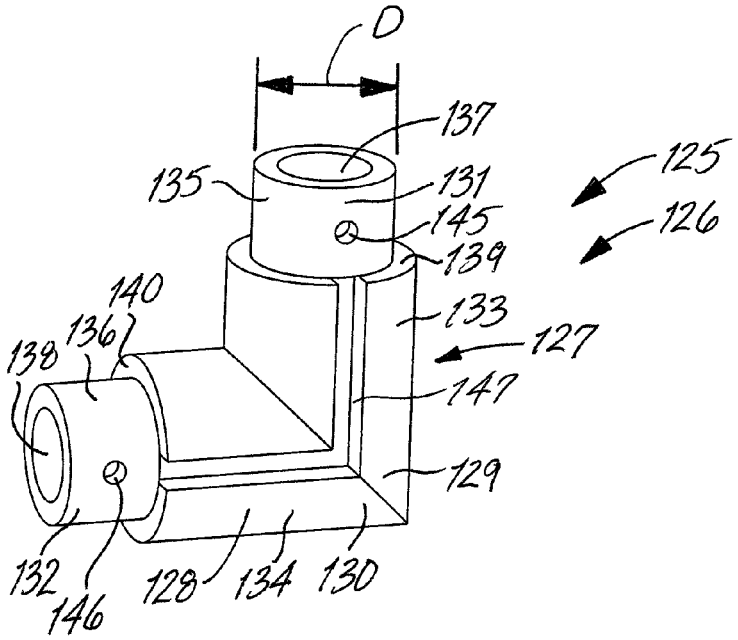
FIG. 4 is a perspective view of a right angle joint according to an embodiment of the present invention.

With continued reference to FIGS. 2B and 3, the gate 101 also includes two right angle elbow connectors or joints 125, 126 configured to couple the opposite ends 121, 122 of the lower horizontal support 113 to the lower ends 116 of the vertical support posts 111, 112, respectively. As illustrated in FIG. 4, each elbow joint 125, 126 includes a vertical leg 127 interconnected to a horizontal leg 128 extending inward from the vertical leg 127. The vertical and horizontal legs 127, 128 each include an interconnected end 129, 130, respectively, and a free end 131, 132, respectively, opposite the interconnected end 129, 130. The vertical legs 127 of the elbow joints 125, 126 are configured to be coupled to the lower ends 116 of the vertical support posts 111, 112 and the horizontal legs 128 of the elbow joints 125, 126 are configured to be coupled to the opposite ends 121, 122 of the lower horizontal support 113. In the illustrated embodiment, the vertical and horizontal legs 127, 128 of the elbow joints 125, 126 include tubular body portions 133, 134 having an outer diameter and an inner diameter.

Still referring to the embodiments illustrated in FIGS. 3 and 4, the free ends 131, 132 of the vertical and horizontal legs 127, 128 include annular lips 135, 136 having an outer diameter D and an inner diameter. The inner diameters of the annular lips 135, 136 are defined by smooth bores 137, 138 extending along at least a portion of the legs 127, 128. The outer diameter D of the annular lips 135, 136 is smaller than the outer diameter of the body portions 134, 135 of the legs 127, 128 such that shoulders 139, 140 are defined between the annular lips 135, 136 and the body portions 134, 135 of the legs 127, 128. In one embodiment, the outer diameters D of the annular lips 135, 136 of the elbows 125, 126 are slightly smaller than the inner diameters d of the vertical support posts 111, 112 and the lower horizontal support 113 such that the annular lips 135, 136 of the elbow joints 125, 126 are configured to be inserted into the smooth bores 114, 120 in the vertical and horizontal supports 111, 112, 113. When the annular lips 135, 136 are inserted into the bores 114, 120 in the supports 111, 112, 113, the shoulders 139, 140 on the elbows 125, 126 are configured to abut the lower ends 116 of the vertical support posts 111, 112 and the opposite ends 121, 122 of the lower horizontal support 113, respectively, as illustrated in FIG. 2B.

The elbow joints 125, 126 may be coupled to the vertical and horizontal supports 111, 112, 113 by any suitable means, such as fasteners (e.g., hex head screws), adhesive, bonding, welding, or brazing. In the illustrated embodiment, the annular lips 135, 136 on the elbows 125, 126 include openings 145, 146 (e.g., cylindrical holes), respectively. The openings 145 in the vertical legs 127 are configured to align with the openings 118 in the lower ends 116 of the vertical support posts 111, 112, and the openings 146 in the horizontal legs 128 of the elbows 125, 126 are configured to align with the openings 119, 123 on the opposite sides 121, 122 of the horizontal support 113, as illustrated in FIG. 2B. The openings 118, 119, 123, 145, 146 in the supports 111, 112, 113 and the elbows 125, 126 are configured to receive fasteners securing the elbows 125, 126 to the supports 111, 112, 113. In an alternate embodiment, the outer diameter of the annular lips 135, 136 on the elbows 125, 126 is substantially equal to the inner diameter of the bores 114, 120 in the vertical and horizontal supports 111, 112, 113 such that the elbows 125, 126 are configured to be secured to the vertical and horizontal supports 111, 112, 113 with press fit connections (i.e., interference fit connections). Additionally, in the illustrated embodiment of FIG. 2B, the outer diameters of the tubular body portions 133, 134 of the elbows 125, 126 are substantially equal to the outer diameters of the supports 111, 112, 113 such that the elbows 125, 126 are flush with the supports 111, 112, 113 when the elbows 125, 126 are attached to the supports 111, 112, 113.

With continued reference to the embodiment illustrated in FIG. 4, the elbows 125, 126 may also include narrow channels or grooves 147 configured to increase the structural rigidity of the elbows 125, 126. In the illustrated embodiment, the narrow channels 147 extend along the tubular body portions 133, 134 of the elbows 125, 126. It will be appreciated, however, that the elbows 125, 126 may be provided without the narrow channels 147 and still fall within the scope and spirit of the present invention. The elbows 125, 126 may be made of any suitably strong material, such as fiberglass, fiberglass reinforced nylon, aluminum, carbon fiber reinforced plastic, or steel. The elbows 125, 126 may be formed by any suitable process, such as machining, molding, welding, or rapid prototyping using additive manufacturing.

Figure 9:
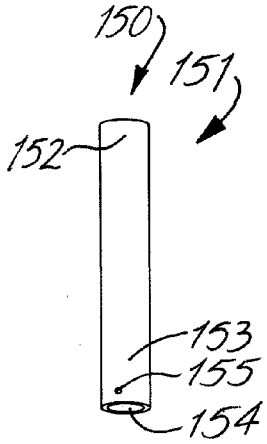
FIG. 9 is a perspective view of an upper post according to an embodiment of the present invention.

With reference now to the embodiments illustrated in FIGS. 2B and 3, the gate 101 includes two upper vertical posts 150, 151 having opposing upper and lower ends 152, 153. In the illustrated embodiment of FIG. 9, the upper vertical posts 150, 151 are thin-walled tubes having an outer diameter and an inner diameter. The inner diameters are defined by a smooth bore 154 extending along at least a portion of the upper posts 150, 151. In the illustrated embodiment, the smooth bores 154 do not extend along the entire length of the upper posts 150, 151 such that the lower ends 153 of the upper vertical posts 150, 151 are open and the upper ends 152 of the upper vertical posts 150, 151 are enclosed (i.e., the bores 154 in the upper vertical posts 150, 151 are open on the lower end 153 and enclosed on the upper end 152). Additionally, the lower ends 153 of the upper vertical posts 150, 151 include openings 155 extending into the bores 154, the significance of which is explained below. The upper posts 150, 151 may be made of any suitably strong material, such as aluminum, steel, fiberglass, or carbon fiber reinforced plastic. The upper posts 150, 151 may be formed by any suitable process, such as machining, extruding, molding, or rapid prototyping using additive manufacturing. In one embodiment, the upper posts 150, 151 and the vertical support posts 111, 112 may be made of dissimilar materials, although the upper posts 150, 151 and the vertical support posts 111, 112 may be made of similar materials and still fall within the scope and spirit of the present invention.

Figure 5:
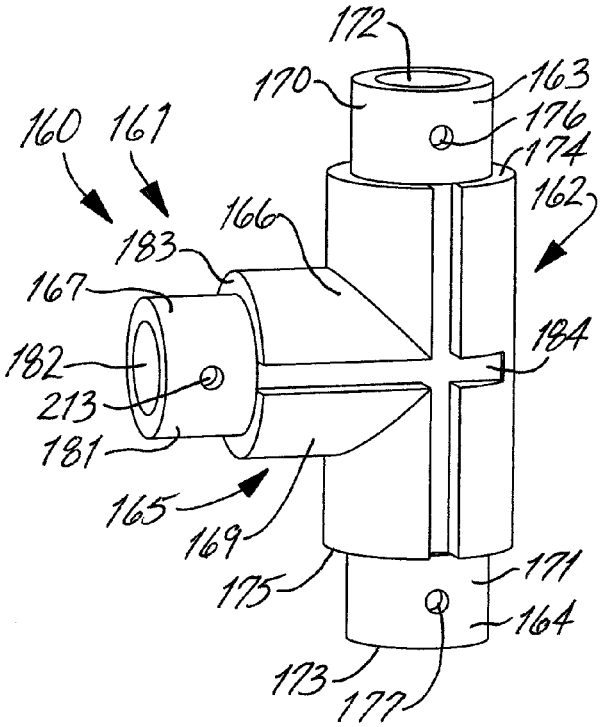
FIG. 5 is a perspective view of a Tee joint according to an embodiment of the present invention.

With continued reference to FIGS. 2B and 3, the gate 101 also includes two Tee connectors or joints 160, 161. In the illustrated embodiment of FIG. 5, each Tee 160, 161 includes a vertical leg 162 having opposing upper and lower ends 163, 164 and a horizontal leg 165 extending inwardly from the vertical leg 162. In the illustrated embodiment, the horizontal leg 165 is equidistantly disposed between the upper and lower ends 163, 164 of the vertical leg 162. The horizontal leg 165 includes an interconnected end 166 connected to the vertical leg 162 and a free end 167 opposite the interconnected end 166. Additionally, the vertical and horizontal legs 162, 165 of the Tee joints 160, 161 include tubular body portions 168, 169 having an outer diameter. The upper and lower ends 163, 164 of the vertical leg 162 of the Tees 160, 161 include thin-walled annular lips 170, 171 having an outer diameter and an inner diameter. The inner diameters of the annular lips 170, 171 are defined by smooth bores 172, 173 extending along at least a portion of the vertical leg 162. The outer diameter of the annular lips 170, 171 is smaller than the outer diameter of the tubular body portion 168 of the vertical leg 162 such that shoulders 174, 175 are defined between the annular lips 170, 171 and the tubular body portion 168 of the vertical leg 162.

With continued reference to FIGS. 2B and 3, the vertical legs 162 of the Tees 160, 161 are configured to couple the lower ends 153 of the upper posts 150, 151 to the upper ends 115 of the vertical support posts 111, 112, respectively. It will be appreciated that when the upper posts 150, 151 are coupled to the Tees 160, 161, the upper posts 150, 151 are substantially coaxial with the vertical support posts 111, 112, respectively. In one embodiment, the outer diameters of the annular lips 170, 171 are slightly smaller than the inner diameters of the upper posts 150, 151 and the vertical support posts 111, 112 such that the annular lips 170, 171 on the vertical legs 162 of the Tees 160, 161 are configured to be inserted into the smooth bores 154, 114 in the upper posts 150, 151 and the vertical support posts 111, 112, respectively. When the annular lips 170, 171 are inserted into the bores 154, 114 in the upper posts 150, 151 and the vertical support posts 111, 112, the shoulders 174, 175 on the Tees 160, 161 are configured to abut the lower ends 153 of the upper posts 150, 151 and the upper ends 115 of the vertical support posts 111, 112, respectively, as illustrated in FIG. 2B.

The Tees 160, 161 may be coupled to the upper posts 150, 151 and the vertical support posts 111, 112 by any suitable means, such as fasteners (e.g., hex head screws), adhesive, bonding, welding, or brazing. In the illustrated embodiment of FIG. 5, the annular lips 170, 171 on the vertical legs 162 of the Tees 160, 161 include openings 176, 177 (e.g., cylindrical holes), respectively. The openings 176 on the upper ends 163 of the vertical legs 162 of the Tees 160, 161 are configured to align with the openings 155 in the lower ends 153 of the upper posts 150, 151, and the openings 177 on the lower ends 164 of the vertical legs 162 are configured to align with the openings 117 in the upper ends 115 of the vertical support posts 111, 112, as illustrated in FIG. 2B. The openings 155, 117, 176, 177 in the posts 111, 112, 150, 151 and the Tees 160, 161 are configured to receive fasteners securing the Tees 160, 161 to the posts 111, 112, 150, 151. In an alternate embodiment, the outer diameter of the annular lips 170, 171 on the vertical legs 162 of the Tees 160, 161 are substantially equal to the inner diameter of the bores 154, 114 in the upper posts 150, 151 and the vertical support posts 111, 112 such that the Tees 160, 161 are configured to be secured to the upper posts 150, 151 and the vertical support posts 111, 112 with press fit connections (i.e., interference fit). In the illustrated embodiment of FIG. 2B, the outer diameter of the tubular body portion 168 of the vertical leg 162 of the Tees 160, 161 is substantially equal to the outer diameter of the upper posts 150, 151 and the vertical support posts 111, 112 such that the Tees 160, 161 are flush with the upper posts 150, 151 and the vertical support posts 111, 112 when the Tees 160, 161 are attached to the upper posts 150, 151 and the vertical support posts 111, 112.

With continued reference to FIGS. 2B and 3, the horizontal legs 165 of the Tees 160, 161 are configured to support a cross-brace 180, described in detail below, extending horizontally between the upper post 150 and the vertical support post 111 on one end and the upper post 151 and the vertical support post 112 on the other end. In the illustrated embodiment of FIG. 5, the free ends 167 of the horizontal legs 165 of the Tees 160, 161 include thin-walled annular lips 181 having an outer diameter and an inner diameter. The inner diameters of the annular lips 181 are defined by smooth bores 182 extending along at least a portion of the horizontal leg 165. The outer diameter of the annular lips 181 is smaller than the outer diameter of the tubular body portion 169 of the horizontal leg 165 such that shoulders 183 are defined between the annular lips 181 and the tubular body portion 169 of the horizontal leg 165.

The Tees 160, 161 may also include narrow channels or grooves 184 configured to increase the structural rigidity of the Tees 160, 161. In the illustrated embodiment of FIGS. 2B, 3, and 5, the narrow channels 184 extend along the tubular body portions 168, 169 of the Tees 160, 161. It will be appreciated, however, that the Tees 160, 161 may be provided without the narrow channels 184 and still fall within the scope and spirit of the present invention. The Tees 160, 161 may be made of any suitably strong material, such as fiberglass, fiberglass reinforced nylon, aluminum, carbon fiber reinforced plastic, or steel. The Tees 160, 161 may be made from any suitable process, such as machining, molding, welding, stamping, or rapid prototyping using additive manufacturing.

With reference now to the embodiment illustrated in FIGS. 2A and 2B, the gate 101 also includes a rectangular gate screen 190 having opposing sides 191, 192 and opposing upper and lower ends 193, 194. The gate screen 190 is tensioned between the vertical support post 111 and the upper post 150 on one side 191 and the vertical post 112 and the upper post 151 on the other side 192. Additionally, the lower end 194 of the gate screen 190 is coupled to the lower horizontal support 113. The gate screen 190 includes a plurality of interconnected longitudinal strands 195 and transverse strands 196 disposed in a grid-like pattern, substantially as described above. The strands 195, 196 may be interconnected by any suitable means, such as interlacing, bonding, adhering, or knotting. Together, the longitudinal and transverse strands 195, 196 define a grid of rectangular openings 197 in the gate 101. In one embodiment, the openings 197 are sized to prevent a child's fingers and toes from extending through the gate screen 190 (e.g., approximately 0.25 square inches), thereby inhibiting a child from climbing the gate 101. It will be appreciated, however, that the present invention is not limited to the size of the openings 197 recited above, and openings 197 of any suitable size are within the scope and spirit of the present invention. Additionally, it will be appreciated that the free upper end 193 of the gate screen 190 is flexible and is therefore configured to prevent an individual from climbing over the gate 101. The gate screen 190 may be made of any sufficiently suitable strong and durable material, such as aluminum, nylon, or vinyl-coated metal.

With continued reference to FIGS. 2A and 2B, the gate screen 190 includes edge bindings 198 extending along the sides 191, 192 and ends 193, 194 of the gate screen 190 (i.e., the edge bindings 198 extend around the periphery of the gate screen 190). In one embodiment, the edge bindings 198 are made of a fabric material, such as nylon, acrylic, linen, or cotton. The edge bindings 198 may be attached to the gate screen 190 by any suitable means, such as bonding, adhering, or mechanical fastening (e.g., stitching). The edge bindings 198 are configured to prevent the strands 195, 196 of the gate screen 190 from fraying, which might otherwise prematurely wear down the gate screen 190. Additionally, fasteners 199 securing the gate screen 190 to the vertical and horizontal posts 111, 112, 113 are configured to engage the edge bindings 198. The edge bindings 198 may have any suitable width, such as between approximately 0.25 inch and 2 inches, depending upon various factors, such as the outer diameter of the posts 111, 112, 113 and the size of the gate screen 190. It will be appreciated, however, that the gate screen 190 may be provided without the edge bindings 198 and still fall within the scope and spirit of the present invention.

Figure 10A:
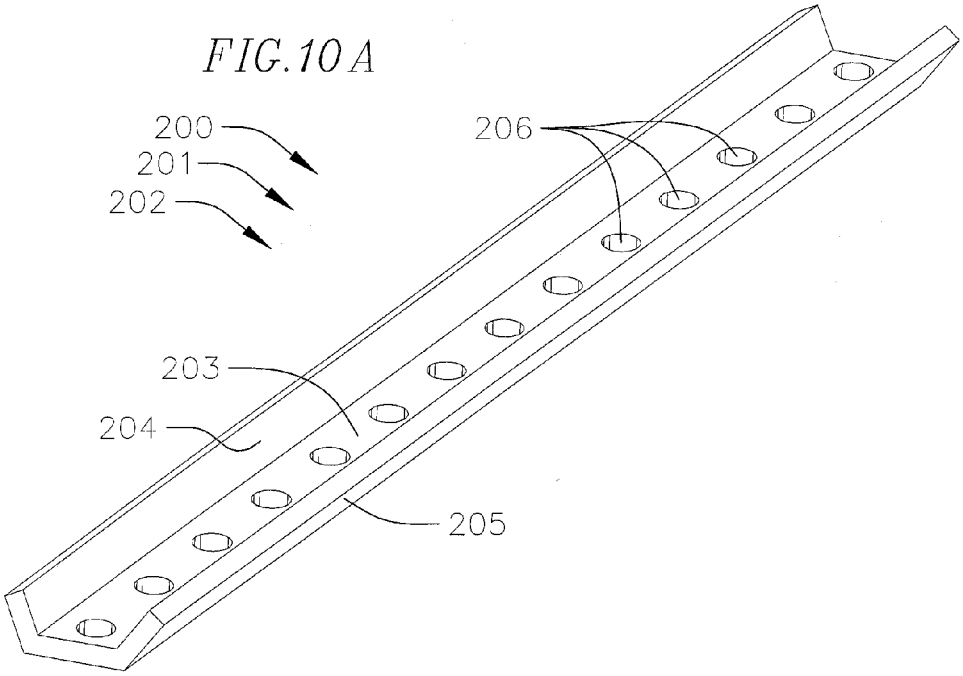
FIGS. 10A and 10B are rear and front perspective views, respectively, of a tensioning plate according to an embodiment of the present invention.
Figure 10B:
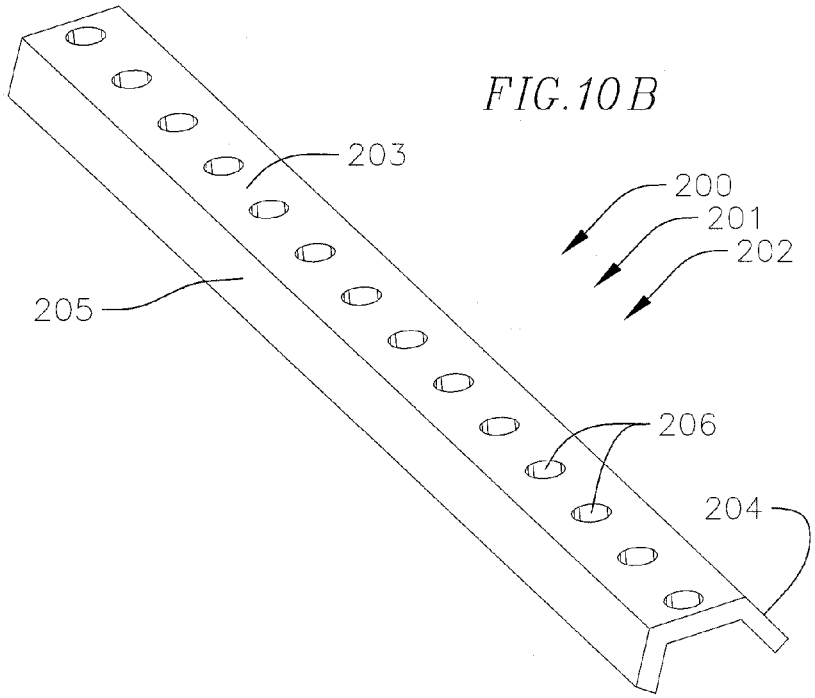

With reference now to the embodiment illustrated in FIGS. 2A, 3, 10A, and 10B, the gate 101 also includes three tensioning plates 200, 201, 202 configured to secure the gate screen 190 to the vertical support posts 111, 112 and the lower horizontal support 113. As illustrated in FIGS. 10A and 10B, each of the tensioning plates 200, 201, 202 includes a flat rectangular base plate 203 and two teeth 204, 205 canted inward from opposite sides of the base plate 203. Together, the flat plate 203 and the teeth 204, 205 have a generally U-shaped transverse cross-section. The first and second tensioning plates 200, 201 have substantially the same length of the sides 191, 192 of the gate screen 190, as illustrated in FIG. 2A. The third tensioning plate 202 is substantially the same length as the lower end 194 of the gate screen 190. The tensioning plates 200, 201, 202 also include a plurality of openings 206 configured to receive the fasteners 199 securing the tensioning plates 200, 201, 202 to the gate screen 190 and the posts 111, 112, 113. When the gate screen 190 and the tensioning plates 200, 201, 202 are installed, the sides 191, 192 of the gate screen 190 are disposed between the tensioning plates 200, 201 and the vertical support posts 111, 112, respectively, and the lower end 194 of the gate screen 190 is disposed between the tensioning plate 202 and the lower horizontal support 113, as illustrated in FIG. 2A. The plurality of fasteners 199 extend through the tensioning plates 200, 201, 202, the edge bindings 198 of the gate screen 190, and the supports 111, 112, 113 to secure the gate screen 190 to the supports 111, 112, 113. When the gate screen 190 and the tensioning plates 200, 201, 202 are installed, the fasteners 199 draw the teeth 204, 205 on the tensioning plates 200, 201, 202 into engagement with the edge bindings 198 of the gate screen 190. Moreover, when the fasteners 199 are installed, head portions of the fasteners 199 abut the flat rectangular bases 203 of the tensioning plates 200, 201, 202. The tensioning plates 200, 201, 202 may be made of any suitably strong material, such as aluminum, steel, fiberglass, or carbon fiber reinforced plastic. The tensioning plates 200, 201, 202 may be formed by any suitable process, such as machining, extruding, molding, stamping, welding, or rapid prototyping using additive manufacturing.

With reference now to the embodiments illustrated in FIGS. 2B and 3, the gate 101 includes a cross-brace 180 configured to add rigidity to the gate 101. The cross-brace 180 on the gate 101 extends between the horizontal legs 165 of the two Tees 160, 161. The cross-brace 180 is disposed on the inner pool-facing side of the gate 101 such that the cross-brace 180 does not present a handgrip or foothold for children to climb over the gate 101 from the outside of the gate 101 (i.e., the cross-brace 180 is disposed between the gate screen 190 and the pool 102 or other structure to which the gate 101 and fence 100 restrict access, as illustrated in FIG. 1). Additionally, the cross-brace 180 is sufficiently spaced below the upper edge 193 of the gate screen 190 such that a child cannot reach over the gate screen 190 from the outside of the gate 101 and grab onto the cross-brace 180, thereby inhibiting children from climbing over the gate 101. In one embodiment, the cross-brace 180 is spaced between approximately 4 inches and approximately 8 inches below the upper edge 193 of the gate screen 190. It will be appreciated, however, that the present invention is not limited to the spacing between the cross-brace 180 and the upper edge 193 of the gate screen 190 recited above, and any suitable spacing may be selected based upon the overall height of the gate 101 and the height of the children to whom the fence 100 and gate 101 are configured to restrict access to the pool 102. In an alternate embodiment, the cross-brace 180 may be aligned with the upper edge 193 of the gate screen 190.

Figure 8:
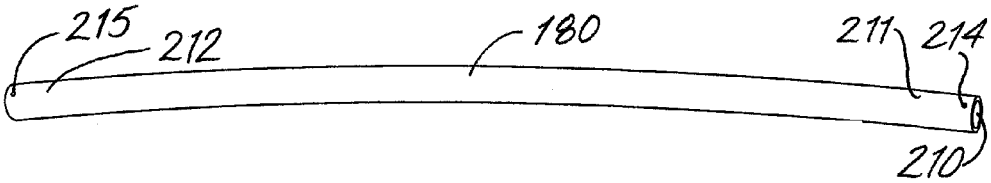
FIG. 8 is a perspective view of a cross brace according to an embodiment of the present invention.

In the illustrated embodiment of FIG. 8, the cross-brace 180 is curved between the two Tees 160, 161 such that opposite ends 211, 212 of the cross-brace 180 are substantially in-line with the gate screen 190 and a middle portion of the cross-brace 180 extends rearwardly away from the gate screen 190 (i.e., the cross-brace 180 curves inward toward the pool 102 such that at least a portion of the cross-brace 180 between the opposite ends 211, 212 is spaced rearwardly away from the gate screen 190). In one embodiment, the middle portion of the cross-brace 180 extends between approximately 1 inch and approximately 3 inches rearwardly away from the gate screen 190. It will be appreciated, however, that the present invention is not limited to the spacing between the cross-brace 180 and the gate screen 190 recited above, and any suitable spacing may be selected based upon the overall height of the gate 101 and the height of the children to whom the fence 100 and gate 101 are configured to restrict access to the pool 102. In an alternate embodiment, the cross-brace 180 may be in direct contact with the gate screen 190.

In the illustrated embodiment of FIG. 8, the cross-brace 180 is a thin-walled tube having an outer diameter and an inner diameter. The inner diameter of the cross-brace 180 is defined by a smooth bore 210 extending the entire length of the cross-brace 180. The cross-brace 180 may be formed by any suitable means, such as machining, molding, welding, stamping, roll forming, or rapid prototyping using additive manufacturing. Although the cross-brace 180 is illustrated as a thin-walled cylindrical tube, the cross-brace 180 may have any other suitable shape, such as a rod, a square bar, or a plate.

The horizontal legs 165 of the Tees 160, 161 are configured to couple opposite ends 211, 212 of the cross-brace 180 to the gate 101. In one embodiment, the outer diameters of the annular lips 181 on the horizontal legs 165 of the Tees 160, 161 are slightly smaller than the inner diameter of the cross-brace 180 such that the annular lips 181 are configured to be inserted into the opposite ends 211, 212 of the smooth bore 210 in the cross-brace 180, as illustrated in FIG. 2B. When the annular lips 181 are inserted into the bore 210 in the cross-brace 180, the shoulders 183 on the Tees 160, 161 are configured to abut the opposite ends 211, 212 of the cross-brace 180.

The Tees 160, 161 may be coupled to the cross-brace 180 by any suitable means, such as fasteners (e.g., hex head screws), adhesive, bonding, welding, or brazing. In the illustrated embodiment of FIG. 5, the annular lip 181 on the horizontal leg 165 of each Tee 160, 161 includes an opening 213 (e.g., cylindrical holes). The opening 213 on the horizontal legs 165 of each Tee 160, 161 is configured to align with openings 214, 215 (see FIG. 8) on the opposite ends 211, 212 of the cross-brace 180. The openings 213, 214, 215 in the Tees 160, 161 and the cross-brace 180 are configured to receive fasteners securing the cross-brace 180 to the Tees 160, 161. In an alternate embodiment, the outer diameter of the annular lip 181 on the horizontal leg 165 of each Tee 160, 161 is substantially equal to the inner diameter of the bore 210 in the cross-brace 180 such that the Tees 160, 161 are configured to be secured to the cross-brace 180 with press fit connections (i.e., interference fit). Additionally, in the illustrated embodiment of FIG. 2B, the outer diameter of the tubular body portion 169 of the horizontal leg 165 of each Tee 160, 161 is substantially equal to the outer diameter of the cross-brace 180 such that the Tees 160, 161 are flush with the cross-brace 180 when the Tees 160, 161 are attached to the cross-brace 180.

Figure 11:
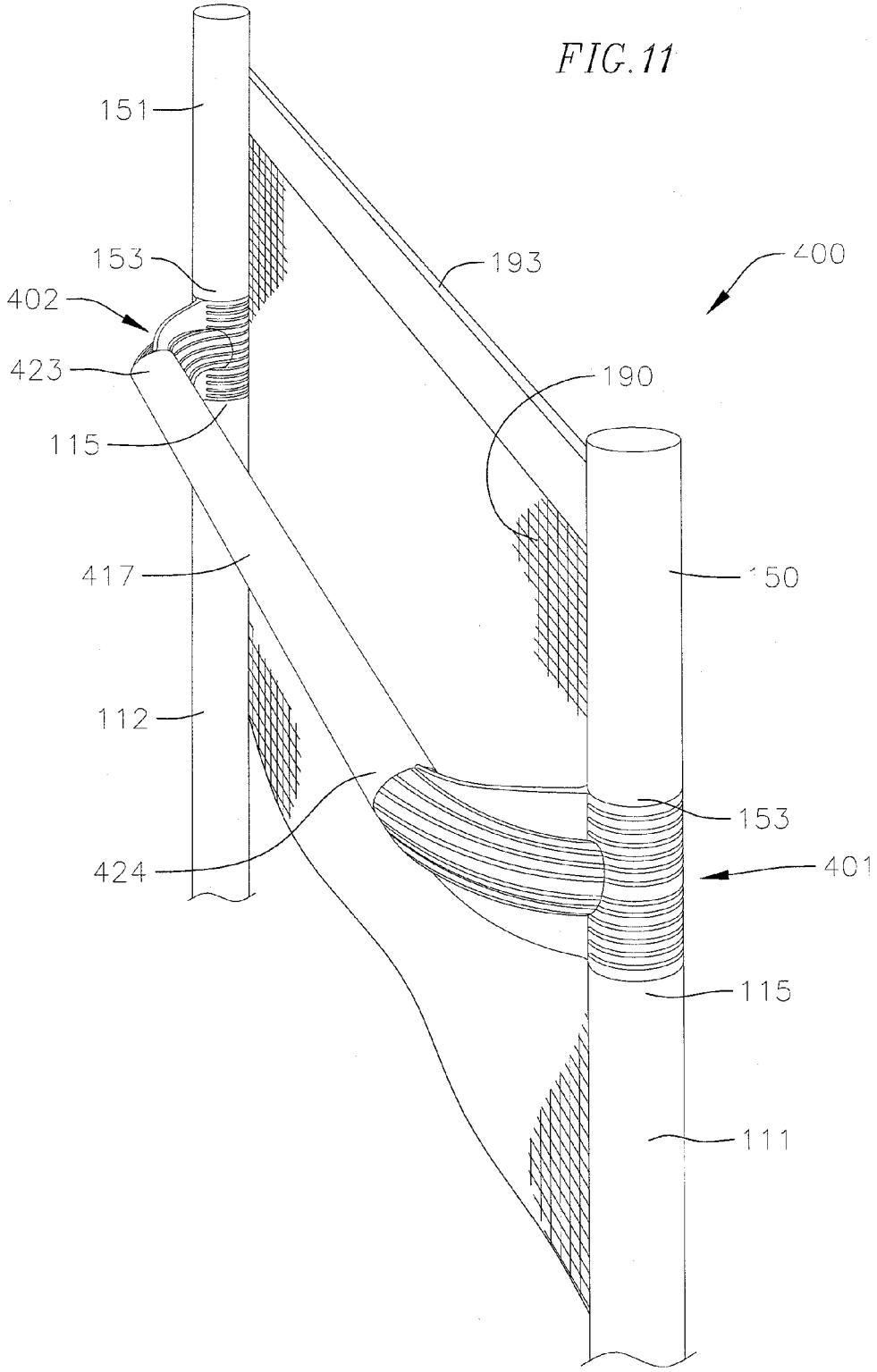
FIG. 11 is a partial rear perspective view of a gate according to another embodiment of the present invention.

With reference now to FIG. 11, a gate 400 according to another embodiment of the present invention is illustrated. The gate 400 includes a pair of vertical support posts 111, 112, a pair of right angle elbows 125, 126 coupling opposite ends of a lower horizontal support 113 to lower ends of the vertical supports posts 111, 112, two upper vertical posts 150, 151, and a rectangular gate screen 190 tensioned between the vertical support posts 111, 112 and the lower horizontal support 113, as described above with reference to gate 101. Accordingly, these common components between gates 101 and 400 will not be described in any further detail below.

Figure 12A:
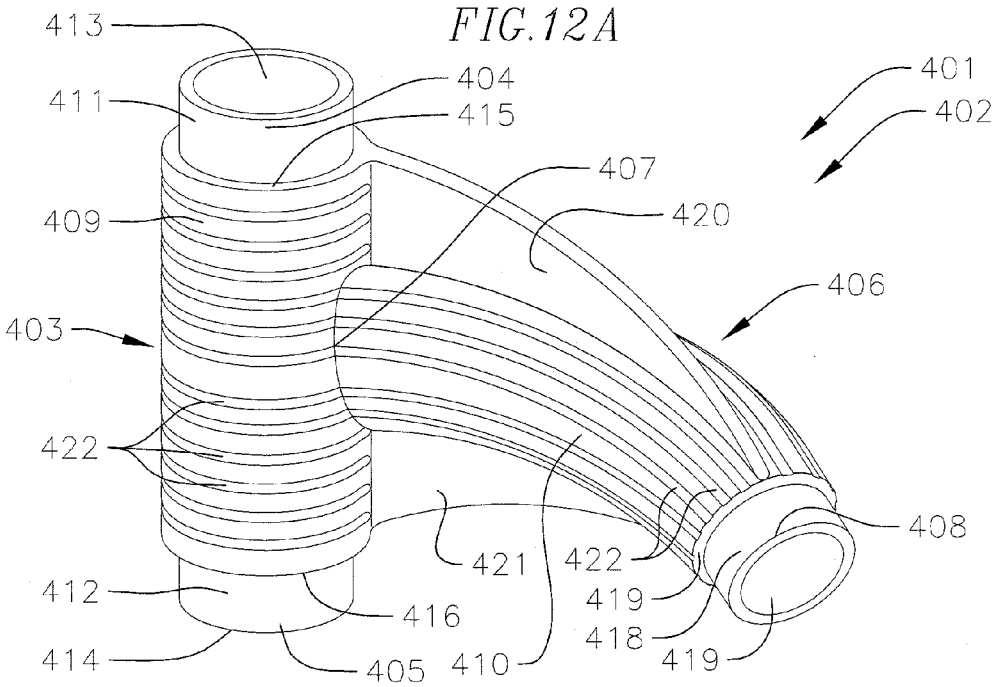
FIGS. 12A and 12B are front and rear perspective views, respectively, of a Tee joint according to the embodiment illustrated in FIG. 11.
Figure 12B:
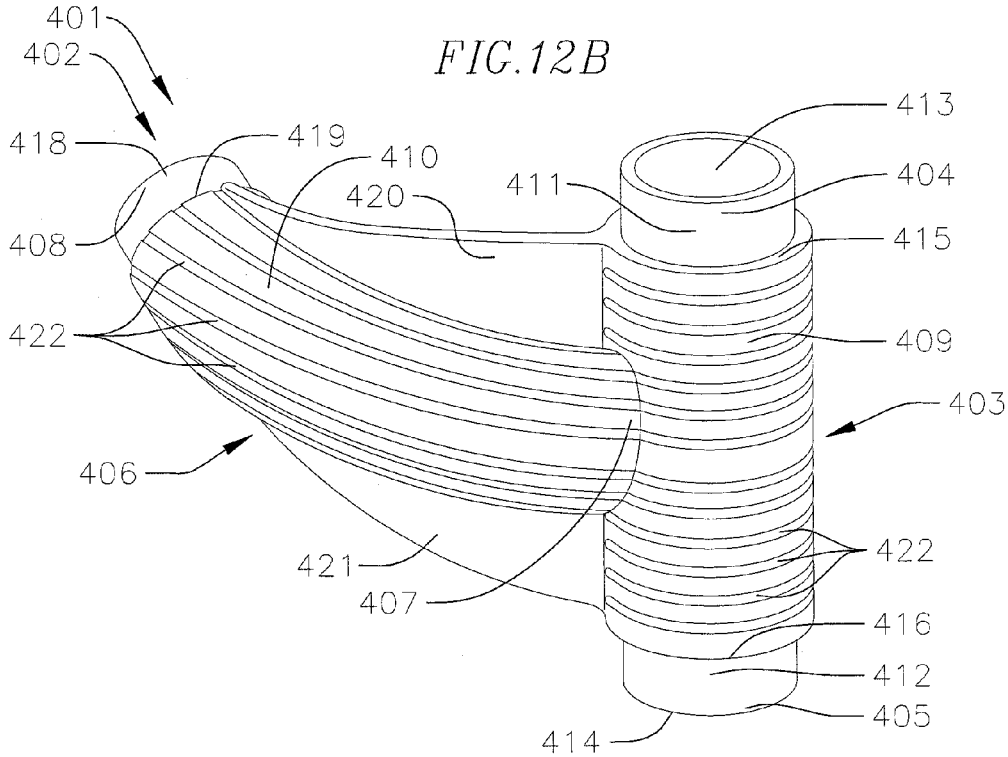

With reference now to FIGS. 12A and 12B, the gate 400 also includes a pair of Tee connectors 401, 402. Each of the Tees 401, 402 includes a vertical leg 403 having opposing upper and lower ends 404, 405 and a horizontal leg 406 curved inwardly from the vertical leg 403 (i.e., the horizontal leg 406 is curved inwardly toward the pool or other structure to which the gate and fence restrict access). In the illustrated embodiment, the horizontal leg 406 is equidistantly disposed between the upper and lower ends 404, 405 of the vertical leg 403. The curved horizontal leg 406 includes an interconnected end 407 connected to the vertical leg 406 and a free end 408 opposite the interconnected end 407. Additionally, the vertical and horizontal legs 403, 406, respectively, of the Tee joints 401, 402 include tubular body portions 409, 410 having an outer diameter. In the illustrated embodiment, the upper and lower ends 404, 405 of the vertical leg 403 of the Tees 401, 402 include thin-walled annular lips 411, 412 having an outer diameter and an inner diameter. The inner diameters of the annular lips 411, 412 are defined by smooth bores 413, 414 extending along at least a portion of the vertical leg 406. In an alternate embodiment, the vertical leg 403 may be a solid cylindrical rod. The outer diameter of the annular lips 411, 412 is smaller than the outer diameter of the tubular body portion 409 of the vertical leg 403 such that upper and lower shoulders 415, 416 are defined between the annular lips 411, 412 and the tubular body portion 409 of the vertical leg 403.

With reference now to FIGS. 11, 12A and 12B, the vertical legs 403 of the Tees 401, 402 are configured to couple the lower ends 153 of the upper posts 150, 151 to the upper ends 115 of the vertical support posts 111, 112, respectively. When the upper posts 150, 151 are coupled to the Tees 401, 402, the upper posts 150, 151 are substantially coaxial with the vertical support posts 111, 112, as shown in FIG. 11. In one embodiment, the outer diameters of the annular lips 411, 412 are slightly smaller than the inner diameters of the upper posts 150, 151 and the vertical support posts 111, 112 such that the annular lips 411, 412 on the vertical legs 403 of the Tees 401, 402 are configured to be inserted into the bores 154, 114 (see FIGS. 6 and 9) in the upper posts 150, 151 and the vertical support posts 111, 112. Additionally, when the annular lips 411, 412 are inserted into the bores 154, 114 in the upper posts 150, 151 and the vertical support posts 111, 112, respectively, the shoulders 415, 416 on the Tees 401, 402 are configured to abut the lower ends 153 of the upper posts 150, 151 and the upper ends 115 of the vertical support posts 111, 112, respectively, as illustrated in FIG. 11.

The Tees 401, 402 may be coupled to the upper posts 150, 151 and the vertical support posts 111, 112 by any suitable means, such as fasteners (e.g., hex head screws), adhesive, bonding, welding, or brazing. In one embodiment, the annular lips 411, 412 on the vertical legs 403 of the Tees 401, 402 include openings (e.g., cylindrical holes) configured to align with openings in the lower ends 153 of the upper posts 150, 151 and openings in the upper ends 115 of the vertical support posts 111, 112. The openings in the posts 111, 112, 150, 151 and the Tees 401, 402 are configured to receive fasteners securing the Tees 401, 402 to the posts 111, 112, 150, 151. In an alternate embodiment, the outer diameter of the annular lips 411, 412 on the vertical legs 403 of the Tees 401, 402 are substantially equal to the inner diameter of the bores 154, 114 in the upper posts 150, 151 and the vertical support posts 111, 112 such that the Tees 401, 402 are configured to be secured to the upper posts 150, 151 and the vertical support posts 111, 112 with press fit connections (i.e., interference fit connections). In the illustrated embodiment of FIG. 11, the outer diameter of the tubular body portion 409 of the vertical leg 403 of the Tees 401, 402 is substantially equal to the outer diameter of the upper posts 150, 151 and the vertical support posts 111, 112 such that the Tees 401, 402 are flush with the upper posts 150, 151 and the vertical support posts 111, 112 when the Tees 401, 402 are attached to the upper posts 150, 151 and the vertical support posts 111, 112.

With continued reference to FIGS. 11, 12A, and 12B, the horizontal legs 406 of the Tees 401, 402 are configured to support a cross-brace 417, described below, extending horizontally between the upper post 150 and the vertical support post 111 on one end and the upper post 151 and the vertical support post 112 on the other end (i.e., the cross-brace 417 extends transversely across the gate screen 190). In the illustrated embodiment of FIGS. 12A and 12B, the free end 408 of the horizontal leg 406 of the Tees 401, 402 includes a thin-walled annular lip 418 having an outer diameter and an inner diameter. The inner diameter of the annular lip 418 is defined by a smooth bore 419 extending along at least a portion of the horizontal leg 406. In an alternate embodiment, the horizontal leg 406 may be a solid cylindrical rod. The outer diameter of the annular lip 418 is smaller than the outer diameter of the tubular body portion 410 of the horizontal leg 406 such that a shoulder 419 is defined between the annular lip 418 and the tubular body portion 410 of the horizontal leg 406.

With continued reference to FIGS. 11, 12A and 12B, the cross-brace 417 is configured to add rigidity to the gate 400. The cross-brace 417 on the gate 400 extends between the horizontal legs 406 of the two Tees 401, 402, as illustrated in FIG. 11. The cross-brace 417 is disposed on the inner pool-facing side of the gate 400 such that the cross-brace 417 does not present a handgrip or foothold for children to climb over the gate 400 from the outside of the gate 400 (i.e., the cross-brace 417 is disposed between the gate screen 190 and the pool 102 or other structure to which the gate 400 and fence 100 restrict access). Additionally, in the illustrated embodiment of FIG. 11, the cross-brace 417 is both spaced below the upper edge 193 of the gate screen 190 and spaced rearwardly away from the gate screen 190 such that a child cannot reach over the gate screen 190 from the outside of the gate 400 and grab onto the cross-brace 417, thereby inhibiting children from climbing over the gate 400 from the outside of the gate 400. In one embodiment, the cross-brace 417 is spaced between approximately 4 inches and approximately 8 inches below the upper edge 193 of the gate screen 190 and spaced between approximately 2 inches and approximately 3 inches rearwardly away from the gate screen 190 inches. It will be appreciated, however, that the present invention is not limited to the spacing between the cross-brace 417 and gate screen 190 recited above, and any suitable spacing may be selected based upon the overall height of the gate 400 and the height of the children to whom the fence 100 and gate 400 are configured to restrict access to the pool 102. In an alternate embodiment, the cross-brace 417 may be aligned with the upper edge 193 of the gate screen 190. Additionally, in another embodiment, the cross-brace 417 may be in direct contact with the gate screen 190.

In the illustrated embodiment of FIG. 11, the cross-brace 417 includes a straight thin-walled cylindrical tube having an inner diameter and an outer diameter. The inner diameter of the cross-brace 417 is defined by an opening extending the entire length of the cross-brace 417. The cross-brace 417 may be formed by any suitable means, such as machining, molding, welding, stamping, roll forming, or rapid prototyping using additive manufacturing. Although the cross-brace 417 is illustrated as a thin-walled cylindrical tube, the cross-brace 417 may have any other suitable shape, such as a cylindrical rod, a square bar, or a flat plate.

With continued reference to FIG. 11, the horizontal legs 406 of the two Tees 401, 402 are configured to couple opposite ends 423, 424 of the cross-brace 417 to the gate 400. In one embodiment, the outer diameter of the annular lip 418 on the horizontal leg 406 is slightly smaller than the inner diameter of opening in the cross-brace 417 such that the annular lips 418 are configured to be inserted into the opposite ends 423, 424 of the opening in the cross-brace 417, as illustrated in FIG. 11. When the annular lips 418 are inserted into the opening in the cross-brace 417, the shoulders 419 on the Tees 423, 424 are configured to abut the opposite ends 423, 424 of the cross-brace 417.

The Tees 401, 402 may be coupled to the cross-brace 417 by any suitable means, such as fasteners (e.g., hex head screws), adhesive, bonding, welding, or brazing. In one embodiment, the annular lip 418 on the horizontal leg 406 of each Tee 401, 402 includes an opening (e.g., cylindrical hole) configured to align with openings in the opposite ends 423, 424 of the cross-brace 417. The openings in the Tees 401, 402 and the cross-brace 417 are configured to receive fasteners securing the cross-brace 417 to the Tees 401, 402. In an alternate embodiment, the outer diameter of the annular lip 418 on the horizontal leg 406 of each Tee 401, 402 is substantially equal to the inner diameter of the opening in the cross-brace 417 such that the Tees 401, 402 are configured to be secured to the cross-brace 417 with press fit connections (i.e., interference fit connections). Additionally, in the illustrated embodiment of FIG. 11, the outer diameter of the tubular body portion 410 of the horizontal leg 406 of each Tee 401, 402 is substantially equal to the outer diameter of the cross-brace 417 such that the Tees 401, 402 are flush with the cross-brace 417 when the Tees 401, 402 are attached to the cross-brace 417.

With continued reference to the embodiment illustrated in FIGS. 12A and 12B, the Tees 401, 402 each also include upper and lower gussets 420, 421, respectively, configured to increase the rigidity and load-bearing capacity of the Tees 401, 402. In the illustrated embodiment, the upper gusset 420 is a generally triangular, curved plate extending between the upper shoulder 415 of the vertical leg 403 and the shoulder 419 of the horizontal leg 406. Similarly, the lower gusset 421 is a generally triangular, curved plate extending between the lower shoulder 416 of the vertical leg 403 and the shoulder 419 of the horizontal leg 406. It will be appreciated, however, that the gussets 420, 421 may have other suitable configurations and still fall within the scope and spirit of present invention. For instance, the gussets 420, 421 may not extend completely to the shoulders 415, 416, 419 of the vertical and horizontal legs 403, 406.

With continued reference to the embodiment illustrated in FIGS. 12A and 12B, the Tees 401, 402 also include a series of narrow horizontal channels or grooves 422 configured to increase the structural rigidity of the Tees 401, 402. In the illustrated embodiment, the narrow channels 422 extend along the tubular body portions 409, 410 of the Tees 401, 402. In another embodiment, the narrow channels 422 may extend along both the tubular body portions 409, 410 and the gussets 420, 421 of the Tees 401, 402. Additionally, it will be appreciated that the Tees 401, 402 may be provided without the narrow channels 422 and still fall within the scope and spirit of the present invention.

Figure 13:
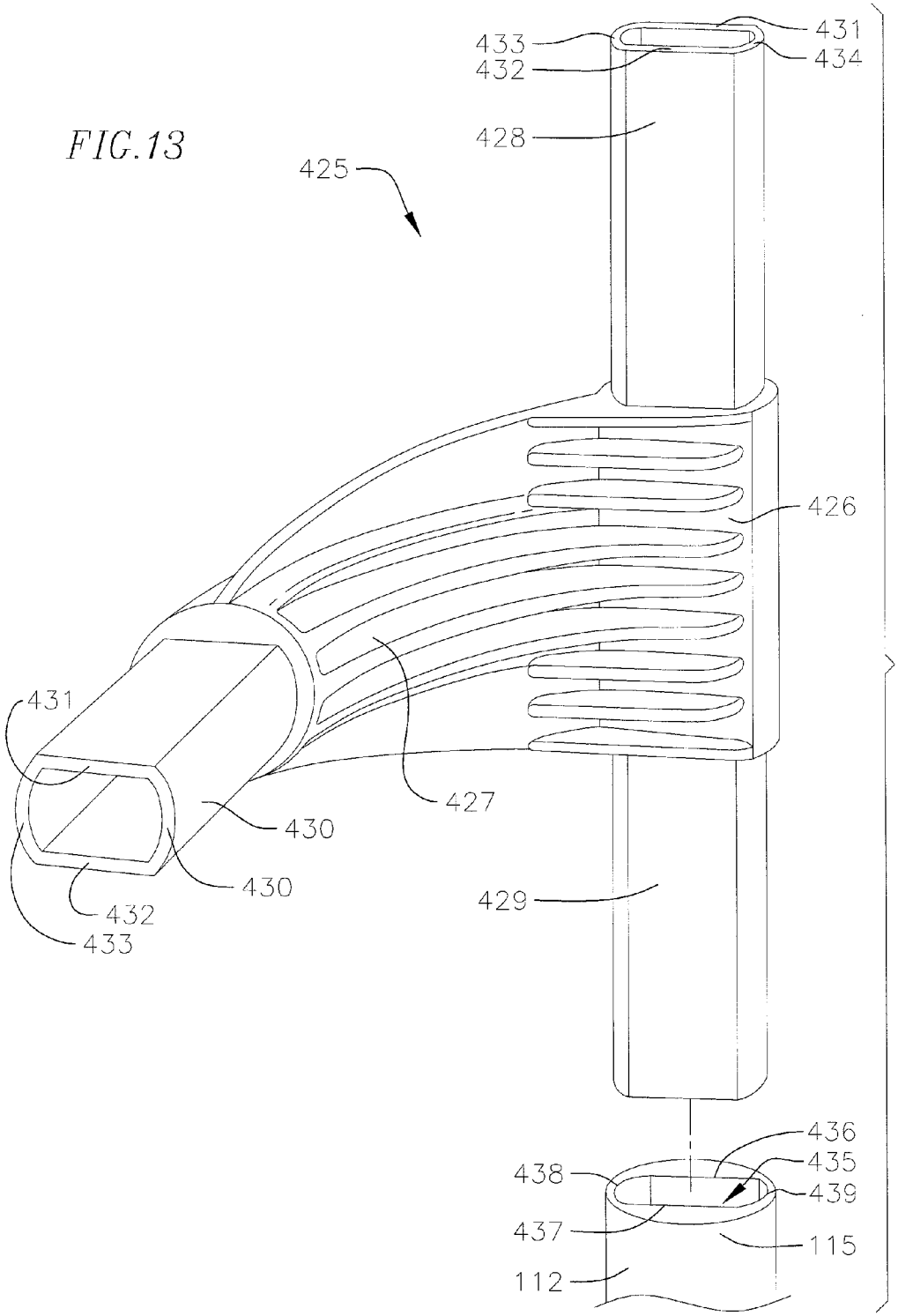
FIG. 13 is a rear perspective view of a Tee joint according to another embodiment of the present invention.

With reference now to FIG. 13, a Tee connector 425 according to another embodiment of the present invention is illustrated. The Tee connector 425 includes a vertical leg 426 and a horizontal leg 427, substantially as described above with reference to FIGS. 12A and 12B. However, the upper and lower ends of the vertical leg 426 and the free end of the horizontal leg 427 include generally rectangular lips 428, 429, 430, respectively, rather than the circular lips 411, 412, 418 illustrated in FIGS. 12A and 12B. The rectangular lips 428, 429, 430 each include two spaced apart straight segments 431, 432 and two arcuate segments 433, 434 connecting opposite ends of the straight segments 431, 432. The rectangular lips 428, 429 on the vertical leg 426 are configured to be received in generally rectangular openings 435 in the upper ends 115 of the vertical support posts 111, 112 and the lower ends 153 of the upper vertical posts 150, 151. Additionally, the rectangular lip 430 on the free end of the horizontal leg 427 is configured to be received in generally rectangular openings in the opposite ends 423, 424 of the cross-brace 417. Moreover, in one embodiment, the elbow joints also include generally rectangular lips, rather than the circular lips 135, 136 illustrated in FIG. 4, which are configured to be received in generally rectangular openings in the lower ends 116 of the vertical support posts 111, 112 and the opposite ends 121, 122 of the lower horizontal support 113. Each of the generally rectangular openings 435 in the upper vertical posts 150, 151, the vertical support posts 111, 112, the cross brace 417, and the lower horizontal support 113 includes two straight segments 436, 437 and two arcuate segments 438, 439 extending between the ends of the straight segments 436, 437. The straight segments 436, 437 and the two arcuate segments 438, 439 of the generally rectangular openings are configured to match the contour of the straight segments 431, 432 and two arcuate segments 433, 434 of the generally rectangular lips on the Tees 425 and the elbows. The rectangular lips 428, 429, 430 on the Tees 425 and the elbows and the corresponding rectangular openings in the upper vertical posts 150, 151, the vertical support posts 111, 112, the cross-brace 417, and the lower horizontal support 113 are configured to prevent the support members 150, 151, 111, 112, 417, and 113 from rotating relative to the Tees 425 and the elbows. Otherwise, such rotation may cause the gate to flex and become misaligned.

Although the Tees and elbows have been describe above with reference to generally rectangular lips having two straight segments, the Tees and elbows may alternately be provided with only one straight segment (i.e., each of the lips on the ends of the Tees and elbows may include an arcuate segment and a single straight segment). Similarly, although the upper vertical posts, the vertical support posts, the cross-brace, and the lower horizontal support have been described above with reference to generally rectangular openings having two straight segments, each of the openings may alternately be provided with only one straight segment. In one embodiment, when the gate is assembled, the single straight segment in each of the openings aligns with the single straight segment on each of the lips on the Tees and elbows in order to prevent the upper vertical posts, the vertical support posts, the cross-brace, and the lower horizontal support from rotating relative to the Tees and elbows.

The rectangular lips 428, 429, 430 may have any suitable length, depending upon the desired connection strength and rigidity between the Tees and elbows and the upper vertical posts, the vertical support posts, and the cross-brace. The rectangular lips 428, 429, 430 may be relatively longer as illustrated in FIG. 13 or relatively shorter as illustrated in FIGS. 12A and 12B with reference to the circular lips 411, 412, 418. It will be appreciated that relatively longer lips on the Tees and elbows are configured to provide a more rigid connection between the Tees and elbows and the upper vertical posts, the vertical support posts, and the cross-brace.

The Tees 160, 161 (or 401, 402 or 425) may be made of any suitably strong material, such as fiberglass, fiberglass reinforced nylon, aluminum, carbon fiber reinforced plastic, or steel. The Tees 160, 161 (or 401, 402 or 425) may be made from any suitable process, such as machining, molding, welding, stamping, or rapid prototyping using additive manufacturing.

Figure 14:
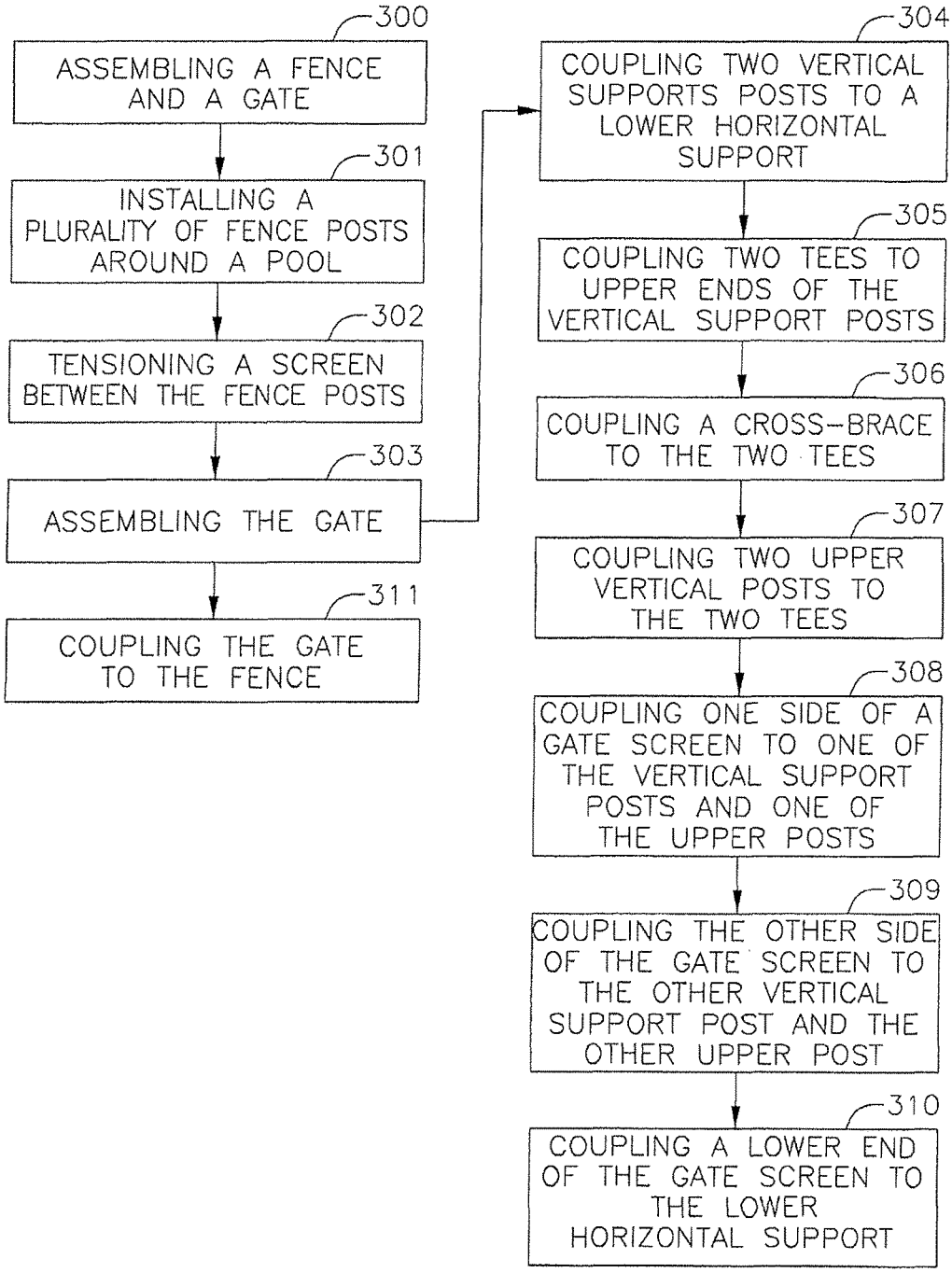
FIG. 14 is a flowchart illustrating the steps of assembling the embodiments of the fence and gate illustrated in FIGS. 1 and 11, according to an embodiment of the present invention.

With reference now to the flowchart illustrated in FIG. 14, a method 300 for assembling the fence 100 and gate 101, 400 of the present invention around a pool 102 or other structure will be described. In one embodiment, the method 300 includes a task 301 of installing a plurality of vertical fence posts 104 around the pool 102 or other structure. The method 300 also includes a task 302 of tensioning a screen 106 between the vertical fence posts 104. The method 300 also includes a task 303 of assembling the gate 101, 400. The task 303 of assembling the gate 101, 400 includes a task 304 of coupling lower ends of two vertical support posts 111, 112 to opposite ends of a lower horizontal support 113, such as with two right angle elbow joints 125, 126. The task 303 of assembling the gate 101 also includes the task 305 of coupling two Tee joints 160, 161 (or 401, 402 or 425) to upper ends of the two vertical support posts 111, 112. The task 303 of assembling the gate 101, 400 also includes a task 306 of coupling the opposite ends of a cross-brace 180 (or 417) to the horizontal legs of the two Tee joints 160, 161 (or 401, 402 or 425). The task 303 of assembling the gate 101, 400 further includes a task 307 of coupling two upper vertical posts 150, 151 to the upper legs of the two Tee joints 160, 161 (or 401, 402 or 425). The task 303 of assembling the gate 101, 400 further includes a task 308 of clamping one side of a gate screen 190 to the first vertical support post 111 and the first upper vertical post 150 with a first tensioning plate 220. The task 303 of assembling the gate 101, 400 also includes a task 309 of clamping the other side of the gate screen 190 to the second vertical support post 112 and the second upper vertical post 151 with a second tensioning plate 201. The task 303 of assembling the gate 101 also includes a task 310 of clamping the lower end of the gate screen 190 to the lower horizontal support 113 with a third tensioning plate 202. The method 300 also includes a task 311 of coupling the gate 101, 400 to the fence 100, such as with two spring-loaded hinges configured to bias the gate in a closed position.

While in one embodiment, the method 300 of assembling the fence 100 and gate 101, 400 may include each of the tasks described above and shown in FIG. 14, in other embodiments of the present invention, one or more of the tasks described above and shown in FIG. 14 may be absent and/or additional tasks may be performed. Furthermore, in the method 300 of assembling the fence 100 and gate 101, 400 according to one embodiment, the tasks may be performed in the order depicted in FIG. 14. However, the present invention is not limited thereto and, in a method 300 of assembling the fence 100 and gate 101, 400 according to other embodiments of the present invention, the tasks described above and shown in FIG. 14 may be performed in any other suitable sequence. For example, in one embodiment, the task 304 of coupling the elbow joints 125, 126 to the vertical support posts 111, 112 is performed before the task 305 of coupling the two Tees 160, 161 (or 401, 402 or 425) to the vertical support posts 111, 112, while in an alternate embodiment, the task 305 of coupling the two Tees 160, 161 (or 401, 402 or 425) to the vertical support posts 111, 112 is performed before the task 304 of coupling the elbow joints 125, 126 to the vertical support posts 111, 112.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," and similar terms have been used herein to describe a spatial relationship of one element to another, it is understood that these terms are intended to encompass different orientations of the various elements and components of the device in addition to the orientation depicted in the figures. Moreover, the figures contained in this application are not necessarily drawn to scale. Although the fence and gate of the present invention are shown and described in use with a pool, the fence and gate are not limited to such applications, and the fence and gate of the present invention may be used to restrict child access to a variety of structures and areas, such as playground structures (e.g., trampolines), buildings, and other private property (e.g., backyards).

What is claimed is:

1. A gate configured to inhibit a child from climbing over the gate and facilitate on-site assembly, the gate comprising:

first and second vertical support posts each having opposing upper and lower ends;

a lower horizontal support having opposing ends;

a cross-brace having opposing ends;

first and second upper vertical posts each having opposing upper and lower ends;

a screen having opposing sides and opposing upper and lower ends;

first and second elbow joints; and first and second Tee joints, wherein:

at least a portion of one of the opposing sides of the screen is configured to be coupled to the first vertical support post and the first upper vertical post;

at least a portion of the other one of the opposing sides of the screen is configured to be coupled to the second vertical support post and the second upper vertical post;

at least a portion of the lower end of the screen is configured to be coupled to the lower horizontal support;

the cross-brace extends between the first and second vertical support posts at a distance below the upper end of the screen when the gate is assembled;

at least a portion of the cross-brace is non-planar with the first and second vertical support posts, the lower horizontal support, and the screen such that the portion of the cross-brace is spaced rearwardly apart from the screen by a gap when the gate is assembled;

the first elbow joint is configured to couple the lower end of the first vertical support post to one of the opposing ends of the lower horizontal support;

the second elbow joint is configured to couple the lower end of the second vertical support post to the other one of the opposing ends of the lower horizontal support;

the first Tee joint is configured to couple the upper end of the first vertical support post, one of the opposing ends of the cross-brace, and the lower end of the first upper vertical post together; and the second Tee joint is configured to couple the upper end of the second vertical support post, the other one of the opposing ends of the cross-brace, and the lower end of the second upper vertical post together.

2. The gate of claim 1, wherein each of the first and second elbow joints comprises:

a vertical leg having a free upper end and a lower end;

a horizontal leg extending inward from the vertical leg, the horizontal leg having an interconnected end connected to the lower end of the vertical leg and a free end opposite the interconnected end;

an annular lip on the free upper end of the vertical leg, the annular lip having an outer diameter; and an annular lip on the free end of the horizontal leg, the annular lip having an outer diameter.

3. The gate of claim 2, wherein:

each of the first and second vertical support posts is a tubular member having inner and outer diameters, the inner diameter defined by smooth bore extending along the vertical support post;

the lower horizontal support is a tubular member having inner and outer diameters, the inner diameter defined by a smooth bore extending along the lower horizontal post;

the annular lips on the vertical legs of the elbow joints are configured to be inserted into the bores in the lower ends of the vertical support posts; and the annular lips on the horizontal legs of the elbow joints are configured to be inserted into the bore in the opposing ends of the lower horizontal support.

4. The gate of claim 2, wherein each of the first and second elbow joints further comprises a narrow groove extending along at least a portion of the vertical and horizontal legs.

5. The gate of claim 3, wherein the outer diameter of the annular lip on the vertical leg of each of the elbow joints is slightly smaller than the inner diameter of the bores in the first and second vertical support posts.

6. The gate of claim 3, wherein the outer diameter of the annular lip on the vertical leg of each of the elbow joint is substantially equal to the inner diameter of the bores in the first and second vertical support posts.

7. The gate of claim 1, wherein each of the first and second elbow joints comprises fiberglass.

8. The gate of claim 1, wherein each of the first and second Tee joints comprises:

a vertical leg having free upper and lower ends;

a horizontal leg extending inward from the vertical leg, the horizontal leg having an interconnected end connected to the vertical leg and a free end opposite the interconnected end, the horizontal leg equidistantly disposed between the upper and lower ends of the vertical leg;

a lip on the free upper end of the vertical leg;

a lip on the free lower end of the vertical leg; and a lip on the free end of the horizontal leg.

9. The gate of claim 8, wherein the horizontal leg is curved.

10. The gate of claim 8, wherein each of the lips on the free upper end of the vertical leg, the free lower end of the vertical leg, and the free end of the horizontal leg have at least one straight segment.

11. The gate of claim 10, wherein:

each of the first and second vertical support posts is a tubular member defining an opening having at least one straight segment;

each of the upper vertical posts is a tubular member defining an opening having at least one straight segment;

the cross-brace is a tubular member defining an opening having at least one straight segment;

the lips on the free upper ends of the vertical legs of the Tee joints are configured to be inserted into the openings in the lower ends of the upper vertical posts such that the at least one straight segment on each of the lips aligns with the at least one straight segment in each of the openings; and the lips on the free lower ends of the vertical legs of the Tee joints are configured to be inserted into the openings in the upper ends of the vertical support posts such that the at least one straight segment on each of the lips aligns with the at least one straight segment in each of the openings; and the lips on the free ends of the horizontal legs of the Tee joints are configured to be inserted into the openings in the opposing ends of the cross-brace such that the at least one straight segment on each of the lips aligns with the at least one straight segment in each of the openings.

12. The gate of claim 8, wherein each of the lips on the free upper end of the vertical leg, the free lower end of the vertical leg, and the free end of the horizontal leg are cylindrical.

13. The gate of claim 12, wherein:

each of the first and second vertical support posts is a tubular member having inner and outer diameters, the inner diameter defined by a smooth bore extending along the vertical support post;

each of the upper vertical posts is a tubular member having inner and outer diameters, the inner diameter defined by a smooth extending along the upper vertical post; the cross-brace is a tubular member having inner and outer diameters, the inner diameter defined by a smooth bore extending along the cross-brace;

the cylindrical lips on the free upper ends of the vertical legs of the Tee joints are configured to be inserted into the bores in the lower ends of the upper vertical posts; and the cylindrical lips on the free lower ends of the vertical legs of the Tee joints are configured to be inserted into the bores in the upper ends of the vertical support posts; and the cylindrical lips on the free ends of the horizontal legs of the Tee joints are configured to be inserted into the bore in the opposing ends of the cross-brace.

14. The gate of claim 1, wherein:

the distance the cross-brace is configured to be spaced below the upper end of the screen is between approximately 4 inches and approximately 8 inches, and the distance the cross-brace is configured to be spaced rearwardly away from the screen is between approximately 2 inches and approximately 3 inches.

15. The gate of claim 1, wherein the cross-brace is curved tubular member.

16. The gate of claim 1, further comprising:

a first tensioning plate configured to clamp one of the opposing sides of the screen to the first vertical support post and the first upper vertical post;

a second tensioning plate configured to clamp the other one of the opposing sides of the screen to the second vertical support post and the second upper vertical post; and a third tensioning plate configured to clamp the lower edge of the screen to the lower horizontal support.

17. The gate of claim 16, wherein each of the tensioning plates comprises a flat plate and a pair of teeth canted inward from opposite sides of the flat plate.

18. The gate of claim 1, further comprising:

upper edge bindings extending along the upper edge of the screen;

lower edge bindings extending along the lower edge of the screen; and side edge bindings extending along the opposing sides of the screen.

* * * * *